US005412458A

United States Patent [19]

Kamaji et al.

[11] Patent Number: 5,412,458

[45] Date of Patent: May 2, 1995

[54] DEVELOPING APPARATUS HAVING LEAF SPRING MEMBER FOR REGULATING MONO-COMPONENT DEVELOPER LAYER

[75] Inventors: Hideki Kamaji; Masae Ikeda; Kazunori Hirose, all of Kawasaki; Yukio Nishio, Kurume, all of Japan

[73] Assignee: Fujitsu Limited, Kawasaki, Japan

[21] Appl. No.: 983,863

[22] PCT Filed: Jul. 6, 1992

[86] PCT No.: PCT/JP92/00858

§ 371 Date: Mar. 5, 1993

§ 102(e) Date: Mar. 5, 1993

[87] PCT Pub. No.: WO93/01530

PCT Pub. Date: Jan. 21, 1993

[30] Foreign Application Priority Data

Jul. 6, 1991 [JP] Japan ..... 3-166002
Jul. 6, 1991 [JP] Japan ..... 3-166003
Jul. 6, 1991 [JP] Japan ..... 3-166015

[51] Int. Cl.[6] ..... G03G 15/08
[52] U.S. Cl. ..... 355/259; 118/261
[58] Field of Search ..... 355/259, 245, 251; 118/657, 658, 261

[56] References Cited

U.S. PATENT DOCUMENTS 4,468,111 8/1984 Yamagata et al. ..... 118/658 X
4,538,898 9/1985 Kanno et al. .
4,674,441 6/1987 Kohyama .
4,696,255 9/1987 Yano et al. ..... 118/653
5,177,323 1/1993 Kohyama .

FOREIGN PATENT DOCUMENTS

0404561A3 12/1990 European Pat. Off. .
0404561A2 12/1990 European Pat. Off. .
54-5741 1/1979 Japan .
59-147160 10/1984 Japan .
63-202771 8/1988 Japan .
4166862 6/1992 Japan .

*Primary Examiner*—R. L. Moses
*Attorney, Agent, or Firm*—Staas & Halsey

[57] ABSTRACT

A developing apparatus provided with a developer holding container (16*a*) which holds a mono-component developer and an electroconductive elastic development roller (16*b*) which is provided inside the developer holding container in a manner enabling it to be driven to rotate. The electroconductive elastic development roller is disposed so that a portion of it is exposed from the developer holding container and contacts the image carrier. The mono-component developer is made to deposit on its rotating surface and form a mono-component developer layer. By the rotation of this, the developer is transferred to the region of contact with the image carrier. The developing apparatus includes an electroconductive leaf spring member (16*c*) for regulating the thickness of the mono-component developer layer of the electroconductive elastic development roller. This electroconductive leaf spring member is supported integrally at one end by a rotatable rigid support member (16*d*) and is made to elastically press against and contact the electroconductive elastic development roller for regulating the thickness of the mono-component developer layer of the electroconductive elastic development roller at the other end. The center of rotation of the rigid support member is substantially positioned on the tangent of the electroconductive leaf spring member and the electroconductive elastic development roller.

31 Claims, 27 Drawing Sheets

Surface potential of developer carrier (v)
-300
-200
-100
0
SL
Time
Deviation angle -5°
Deviation angle 0°
Deviation angle 5°

Surface potential of developer carrier (v)
-300
-200
-100
0
SL
Time
Deviation angle -5°
Deviation angle 0°
Deviation angle 5°

$0 \leqq d \leqq 0.3$ $d \leqq -0.50$

DEVELOPING APPARATUS HAVING LEAF SPRING MEMBER FOR REGULATING MONO-COMPONENT DEVELOPER LAYER

BACKGROUND OF THE INVENTION

1. Field of the Invention

The present invention relates to a developing apparatus which develops an electrostatic latent image held on an image carrier such as a photosensitive material or a dielectric by a mono-component developer.

2. Description of the Related Art

In electronic photocopying machines, electronic photoprinters, and other electrostatic recording apparatuses, an electrostatic latent image is drawn on an image carrier such as a photosensitive material or a dielectric, that electrostatic latent image is developed electrostatically as a charged toner image by a developer, then the charged toner image is electrostatically transferred to a recording medium such as recording paper, then is fixed on the recording medium by heat, pressure, light, etc.

As a developer used in the development process, in general two-component developers comprised of a toner component (fine particles of a coloring resin) and a magnetic component (fine magnetic carrier) are widely known. A developing apparatus using a two-component developer is provided with a developer holding container, an agitator for agitating the two-component developer in the developer holding container and causing frictional charging between the toner particles and the magnetic carrier, and a magnetic roller for attracting part of the magnetic carrier by magnetic force and forming a magnetic brush, that is, a development roller. Part of the development roller is made to be exposed from the developer holding container and face the image carrier. Toner particles electrostatically deposit on the magnetic brush formed on the circumference of the development roller. By the rotation of the development roller, the toner particles are transported to the region facing the image carrier along with the magnetic brush, that is, the development region, where the electrostatic latent image is developed. In short, the magnetic carrier in the two-component developer is given two functions: the function of causing charging friction of the toner and the function of transporting the toner to the development region.

In such a developing apparatus for a two-component developer, there is the advantage that the transportability of the toner particles, which governs the quality of the developed toner image, that is, the quality of the recorded toner image, is relatively excellent, but to maintain that excellent toner transportability, the ratio of the components of the toner particles and the magnetic carrier has to be maintained within a predetermined range and the magnetic carrier has to be periodically replaced. That is, the toner component is consumed by the development, so the toner component must be suitably resupplied. Also, the magnetic carrier must be replaced when degraded.

Therefore, attention has been focused on a developing apparatus using a mono-component developer comprised of only fine particles of a coloring resin, that is, the toner component, as a developing apparatus which does not require the troublesome maintenance as in the case of a two-component developer. In the case of a mono-component developer, especially a nonmagnetic type mono-component developer, however, how the toner particles are charged and how they are transported to the development region become important issues. This is to say that the quality of the developed toner image, that is, the quality of the recorded toner image, is largely governed by the charging characteristic of the toner component and the transportability of the toner component.

In a conventional developing apparatus using a mono-component developer, as the transporter of the developer for transporting the toner to the development region, use is made of an elastic development roller formed from an electroconductive synthetic rubber material, an electroconductive porous synthetic rubber material, etc. The elastic development roller is placed inside the toner holding container and part of it is exposed from the toner holding container and placed in contact with the image carrier. When the elastic development roller is made to rotate, toner particles deposit on the rotating circumferential surface by the frictional force, whereby a toner layer is formed. The toner particles are transported to the development region by this. To develop the electrostatic latent image with a uniform development density, however, the thickness of the toner layer must be kept uniform.

Therefore, use has been made of a blade, roller, or other thickness-regulating member for the elastic development roller. This removes the excess toner from the toner layer and helps make the toner layer uniform. On the other hand, regarding the charging of the toner, use is made of the frictional static electricity on the elastic development roller or thickness-regulating member, but this frictional static electricity is easily affected by changes in the environment, such as the temperature and humidity, so one practice is to form the thickness-regulating member from a conductive material and apply a voltage of a predetermined polarity so as to positively implant a charge to the individual toner particles at the time of regulating the thickness of the toner layer. Of course, when the frictional static electricity is used, the material of the toner component, the material of the elastic development roller, and the material of the thickness-regulating member are selected so as to give a predetermined charge of the desired polarity to the toner particles. Further, when charge implantation is used, the material of the thickness-regulating member is limited to an electroconductive material.

A problem with the developing apparatus for a mono-component developer such as the one explained above, however, it has been pointed out, is that it is difficult to maintain the uniformity of the thickness of the toner layer by the thickness-regulating member stably over a long period. For example, it has been proposed to use, as the thickness-regulating member able to perform charge implantation, for example, a metal rigid blade having a sharp edge and to engage the edge portion elastically with the elastic development roller to remove the excess toner particles and thereby make the toner layer uniform in thickness. In this case, to ensure the uniformity of the thickness of the toner layer, it is necessary to make the processing precision of the sharp edge portion of the metal rigid blade 2 μm or less. That is, this is because the size of individual toner particles is generally from about 5 to about 10 μm, so if the processing precision of the edge portion is more than 2 μm, uneven streaks will be left on the surface of the toner layer. These streaks will appear as white streaks or black streaks in the recorded toner image. For example, even if it were possible to make the processing precision of the sharp edge portion of the metal rigid blade 2 μm or less, such an edge portion would be susceptible to damage and also the processing cost would become extremely high, so it would be extremely difficult to commercialize this.

It has also been proposed to bring the flat surface of a metal rigid blade or the rotational surface of a metal roller into press-contact with the elastic development roller and regulate the pressure on the toner layer. In this case, it is possible to process the flat surface or the rotational surface at a relatively low cost and a high precision, but the pressure of the metal blade or metal roller applied to the elastic development roller to regulate the thickness of the toner layer to a predetermined thickness must be made considerably large. Therefore, the toner particles are crushed and can physically become fixed to the flat surface or the rotational surface. Of course, even if the toner particles become fixed on the flat surface of the metal rigid plate or the rotational surface of the metal roller, uneven streaks will remain on the surface of the toner layer and those streaks will appear in the recorded toner image in the same way as in the above case. Note that when a hard polymer material etc. is used as the material of the thickness-regulating member, it is not possible to control the charging of the toner particles by charge implantation.

It has been also proposed to use a leaf spring member as a metal thickness-regulating member which is able to stably regulate the thickness of the toner layer over a long period and which can be processed at a relatively low cost and a high precision. This leaf spring member is chamfered at its front edge to give it roundness. The rounded front edge is elastically pressed against the elastic development roller by the spring force of the leaf spring member itself. By this, the thickness of the toner layer is regulated. When such a leaf spring member is used as the toner layer thickness-regulating member, the majority of the excess toner is removed from the toner layer formed on the circumference of the elastic development roller by the rounded front edge of the leaf spring member, then the flat surface of the leaf spring member is used to regulate the thickness of the toner layer, so the pressing force of the flat surface on the elastic development roller can be made relatively small and thus it is possible to prevent the toner particles from fixing on the flat surface. Further, the high precision processing of the flat surface of the leaf spring member and the high precision processing of the rounded front edge of the same can be performed at a relatively low cost. In addition, the rounded front edge is far less susceptible to damage compared with the edge portion of the metal rigid blade mentioned above.

A problem with the leaf spring member explained above, however, it has been pointed out, is the ease of vibration of the leaf spring member L and therefore cyclic fluctuation of the thickness of the toner layer at the time of regulation of the thickness of the toner layer. Of course, if the leaf spring member vibrates and the thickness of the toner layer fluctuates, not only will the development density of the electrostatic latent image be affected, but also at areas where the toner layer has become thicker, the charge of the toner particles will become insufficient and thus there will be contamination of the background region of the electrostatic latent image by the toner particles, i.e., so-called fogging.

On the other hand, even with a leaf spring member, when regulating the thickness of the toner layer and charging the toner particles by charge implantation, the thickness must be made equal to the diameter of the toner particles. In other words, the toner layer should be formed as a single layer of the toner particles. This is because when the thickness of the toner layer is greater than the diameter of the toner particles, the toner layer will include toner particles not able to directly contact the leaf spring member. Such toner particles will not be sufficiently implanted with charges and the amount of charge will become insufficient. Of course, toner particles with insufficient charging become a factor causing fogging.

SUMMARY OF THE INVENTION

Therefore, the object of the present invention is to provide a developing apparatus using a mono-component developer comprised of just a toner component, which developing apparatus is constructed using a metal leaf spring member as the thickness-regulating member so as to enable charge implantation of the toner particles and the leaf spring member is prevented from vibrating at the time of regulation of the toner layer thickness.

Another object of the present invention is to provide a developing apparatus as described above, which is constructed so that all of the toner particles included in the toner layer can be sufficiently charged by charge implantation.

The developing apparatus according to the present invention is one which develops the electrostatic latent image held by the image carrier by a mono-component developer and is provided with a developer holding container which holds the mono-component developer and an electroconductive elastic development roller which is provided inside the developer holding container in a manner enabling it to be driven to rotate. The electroconductive elastic development roller is disposed so that a portion of it is exposed from the developer holding container and contacts the image carrier. The mono-component developer is made to deposit on the rotating surface and form a mono-component developer layer. By the rotation, the developer is transported to the region of contact with the image carrier. The developing apparatus according to the present invention further is provided with an electroconductive leaf spring member for regulating the thickness of the mono-component developer layer of the electroconductive elastic development roller, which electroconductive leaf spring member is supported integrally at one end by a rotatable rigid support member and is made to elastically press against and contact the electroconductive elastic development roller for regulating the thickness of the mono-component developer layer of the electroconductive elastic development roller at the other end. According to the present invention, the developing apparatus is characterized in that the center of rotation of the rigid support member is substantially positioned on the tangent of the electroconductive leaf spring member and the electroconductive elastic development roller.

BRIEF DESCRIPTION OF THE DRAWINGS

The present invention will be explained in further detail with reference to the accompanying drawings.

DESCRIPTION OF THE PREFERRED EMBODIMENT

Figure 1:
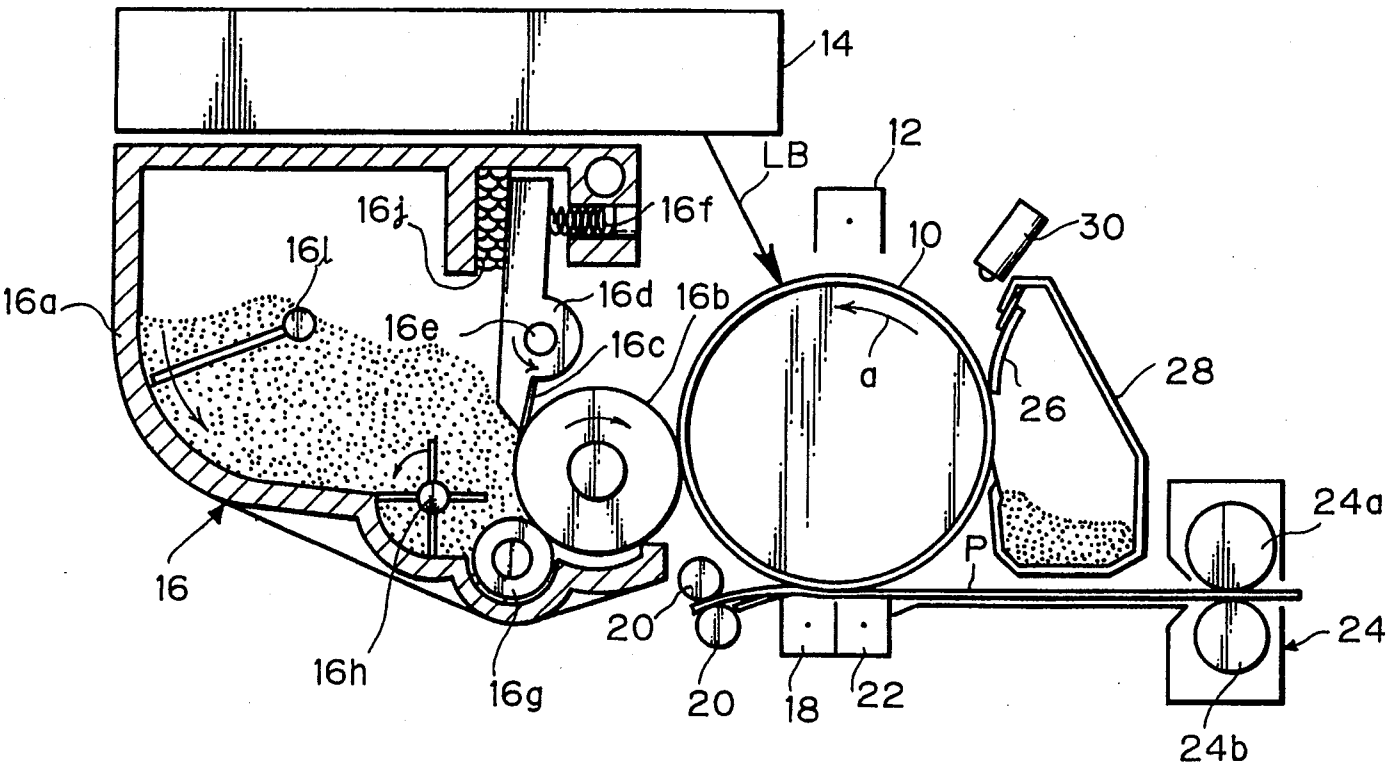
FIG. 1 is a schematic view of a laser printer using the developing apparatus according to the present invention.

Referring to FIG. 1, a laser printer is schematically shown as an example of an electrostatic recording apparatus using the developing apparatus according to the present invention, which laser printer uses a photosensitive drum 10 as the image carrier. The photosensitive drum 10, for example, forms a photoconductive layer, that is, a photosensitive film layer, on the surface of a cylindrical substrate made of aluminum. As such a photosensitive material, for example, use may be made of an organic photosensitive material, a selenic photosensitive material, an amorphous silicon photosensitive material, etc. In the present embodiment, the photosensitive drum 10 is rotated in the direction shown by the arrow a. The rotational speed is set so that the peripheral speed of the photosensitive drum 10 becomes 70 mm/s.

A negative charge is given to the photosensitive film layer of the photosensitive drum 10 by a suitable charger, for example, a scorotron charger 12. The surface potential of the charged region is made, for example, −650V. Note that in the embodiment, use is made of an organic photosensitive material as the photosensitive material, so a negative charge is given to the photosensitive drum 10, but when use is made of a selenic photosensitive material, a positive charge is given to the photosensitive drum 10. Further, when use is made of an amorphous silicon photosensitive material, either a negative or a positive charge is given. An electrostatic latent image is drawn in the charged region of the photosensitive drum 10 by a laser beam scanning unit 14. This drawing of the electrostatic latent image is performed by repeatedly scanning a laser beam LB emitted from the laser beam scanning unit 14 along the genetrix direction of the photosensitive drum 10 and turning on and off the laser beam LB based on the binary image data from a word processor or microcomputer, for example. That is, the charges of the locations where the laser beam LB is irradiated are drained (the aluminum cylindrical substrate of the photosensitive drum 10 is grounded), whereby an electrostatic latent image is formed by the potential difference in the charged region. Note that the locations where the charges are drained by the irradiation of the laser beam LB are called charge wells, the potentials of which are raised from about −650V to about −100V (falling as absolute value).

The electrostatic latent image drawn by the laser beam scanning unit 14 is developed as a charged toner image by the developing apparatus 16. The developing apparatus 16 is provided with a developer holding container **16*a* which holds the mono-component developer comprised of just the toner component and a development roller 16*b* which is arranged in the developer holding container 16*a* and is rotated in the direction of rotation indicated by the arrow in the figure. Note that here, as the nonmagnetic type mono-component developer, use is made of a polyester negative polarity toner having a bulk resistance of $4\times10^{14}\Omega$cm and an average particle size of 12 μm. Part of the development roller 16*b* is exposed from the developer holding container 16*a* and is pressed against the photosensitive drum 10. The shaft of the development roller 16*b* is connected and driven through a suitable transmission gear train (not shown) to the same drive source (not shown) of the photosensitive drum 10. Further, it is rotated so that its peripheral speed becomes 175 mm/s, about 2.5 times the peripheral speed 70 mm/s of the photosensitive drum 10. The development roller 16*b* is comprised of an electroconductive elastic roller, but preferably is formed by an electroconductive porous rubber material. As such an electroconductive porous rubber material, use may be made for example of a porous polyurethane rubber material, a porous urethane rubber material, or a porous silicone rubber material into which has been mixed carbon black etc. as a conductivity imparting agent. In the present embodiment, use is made of an electroconductive porous urethane rubber material (made by Toyo Polymer, brandname Rubicel). The average pore size of the electroconductive porous urethane rubber material is 10 μm, the number of pore cells is 200 cells/inch, the bulk resistance is 10 to $10^7\Omega$cm, and the Asker C hardness is 23. The development roller 16*b* formed from this material has a superior toner particle transportability. When the development roller 16*b*** is rotated, the toner particles deposit on the rotating surface by the frictional force etc. and a toner layer is successively formed.

Further, the developing apparatus 16 is provided with a thickness-regulating member **16*c* for regulating the thickness of the toner layer formed on the development roller 16*b* to a predetermined thickness. This thickness-regulating member 16*c* can be formed from a suitable metal material as a leaf spring member. In this embodiment, the thickness-regulating member, that is, the leaf spring 16*c*, is formed from stainless steel (SUS304-CSP-3/4H) of a thickness of 0.1 mm. The leaf spring member 16*c* is fixed to a rotatable rigid support member 16*d*. At this time, one end of the leaf spring member 16*c* is made to protrude from the front end of the rigid support member 16*d*. The rigid support member 16*d* is mounted on a shaft 16*e* rotatably supported between the two walls of the developer holding container 16*a*. Further, a suitable spring means, for example, the coil spring 16*f*, acts on the rigid support member 16*d*, as shown in FIG. 1. By this, the rigid support member 16*d* is elastically deviated to the direction shown by the arrow in the figure. At this time, the protruding end of the leaf spring member 16*c* is pressed against the development roller 16*b* by a linear pressure of, for example, 35 gf/cm. Further, the front edge of the protruding end of the leaf spring member 16*c* is chamfered to give it roundness. The radius of the rounded front edge is, for example, made 0.05 mm. Therefore, when the development roller 16*b* is rotating, the majority of the excess toner particles is removed from the successively formed toner layer by the rounded front edge of the leaf spring member 16*c*, then the flat surface of the leaf spring member 16*c* is used to regulate the thickness of the toner layer. Even if the pressing force of the flat surface on the development roller 16*b*** is comparatively small, it is possible to regulate the thickness of the toner layer to a desired thickness and it is possible to prevent the toner particles from being fixed to the flat surface.

When the developing apparatus 16 is operating, a voltage of, for example, −400V is applied to the leaf spring member 16c, whereby a negative charge implantation is positively performed on the toner particles of the toner layer and the toner particles are charged by the negative charge. On the other hand, a development bias voltage of −300V is applied to the development roller 16b, therefore the charged toner particles can electrostatically deposit on the electrostatic latent image region, but deposition of the charged toner particles on the background region is prevented and therefore the electrostatic latent image is developed. Note that in the present embodiment, as the metal material of the leaf spring member 16c, use was made of stainless steel, but other metal materials, for example, phosphor bronze, cupronickel, cold rolled steel sheet, constant-modus alloy, beryllium-copper alloy, etc. may be used.

The developing apparatus 16 is further provided with a toner reclamation and supply roller 16g, a rotational paddle 16h, and a toner agitating blade 16i. The toner reclamation and supply roller 16g preferably is formed from an electroconductive sponge material, for example, an electroconductive sponge material having a number of pore cells of about 40 cells/inch and a bulk resistance of $10^4\Omega$cm (made by Bridgestone, Everlight TS-E) and is pressed against the development roller 16b and rotated in the same direction as the development roller 16b so that its peripheral speed becomes 228 mm/s. The toner reclamation and supply roller 16g functions to scrape off from the development roller 16b the residual toner particles not used for the development of the electrostatic latent image at one side (that is, the right side in FIG. 1) of the region of press-contact with the development roller 16b and positively supplies and deposits toner particles on the development roller 16b at the opposite side (that is, the right side of FIG. 1) of the press-contact region. Further, a voltage of −400V, for example, may be applied to the toner reclamation and supply roller 16g. In this case, the entry of toner particles into the sponge material of the toner reclamation and supply roller 16g is electrostatically inhibited and the supply of the toner particles to the development roller 16b is performed electrostatically as well. The rotational paddle 16h is rotated so that the toner particles inside the developer holding container 16a are supplied to the toner supply side of the toner reclamation and supply roller 16h. Further, the toner agitator blade 16i is rotated so as to remove the dead stock of the developer in the developer holding container 16a. Note that in FIG. 1, reference numeral 16j is a deformable sealing material, for example, a soft sponge. The outflow of the toner particles is inhibited by the sealing material 16j.

The charged toner image obtained by the development process is next electrostatically transferred on the recording medium, for example, recording paper P, by a suitable transfer device, for example, a corotron transfer device. That is, a charge of a polarity opposite to the charged toner image, that is, a positive charge, is given to the recording paper P from the corotron transfer device 18, whereby the charged toner image is electrostatically transferred from the photosensitive drum 10 to the recording paper P. Note that the recording paper P is fed out from a paper cassette (not shown), then is stopped once at the location of the pair of resist rollers 20, 20. Next, when the pair of resist rollers are driven at a predetermined timing, the recording paper P is introduced between the photosensitive drum 10 and the corotron transfer device 18, whereby the charged toner image is transferred from the photosensitive drum 10 on the recording paper P at a predetermined location of the same. The recording paper P just after passing through this transfer process is given a negative charge by a charge eliminator 22, whereby a part of the positive charge of the recording paper P is neutralized and therefore the electrostatic attraction force between the recording paper P and the photosensitive drum 10 is weakened. By this, the recording paper P is kept from being electrostatically attracted by the photosensitive drum 10 and becoming entangled with it. Next, the recording paper P is sent to the heat fixer 24, where the transferred toner image is heat fixed on the recording paper P. That is, the heat fixer 24 is comprised of a heat roller 24a and a backup roller 24b. When a recording paper P is passed between the two, the transferred toner image melts and is strongly fixed on the recording paper P.

Note that in FIG. 1, reference numeral 26 shows the toner scraping blade for removing the residual toner particles left on the photosensitive drum 10 without being transferred from the photosensitive drum 10 to the recording paper P in the transfer process. The toner removed by the toner scraping blade 26 is housed in the toner receiving container 28. Reference numeral 30 shows an LED array functioning as a charge-eliminating lamp. Using the LED array 30, the residual charge is removed from the photosensitive drum 10, whereby the scorotron charger 12 can form a uniform negative charged region on the photosensitive material film of the photosensitive drum 10 once again.

Figure 2:
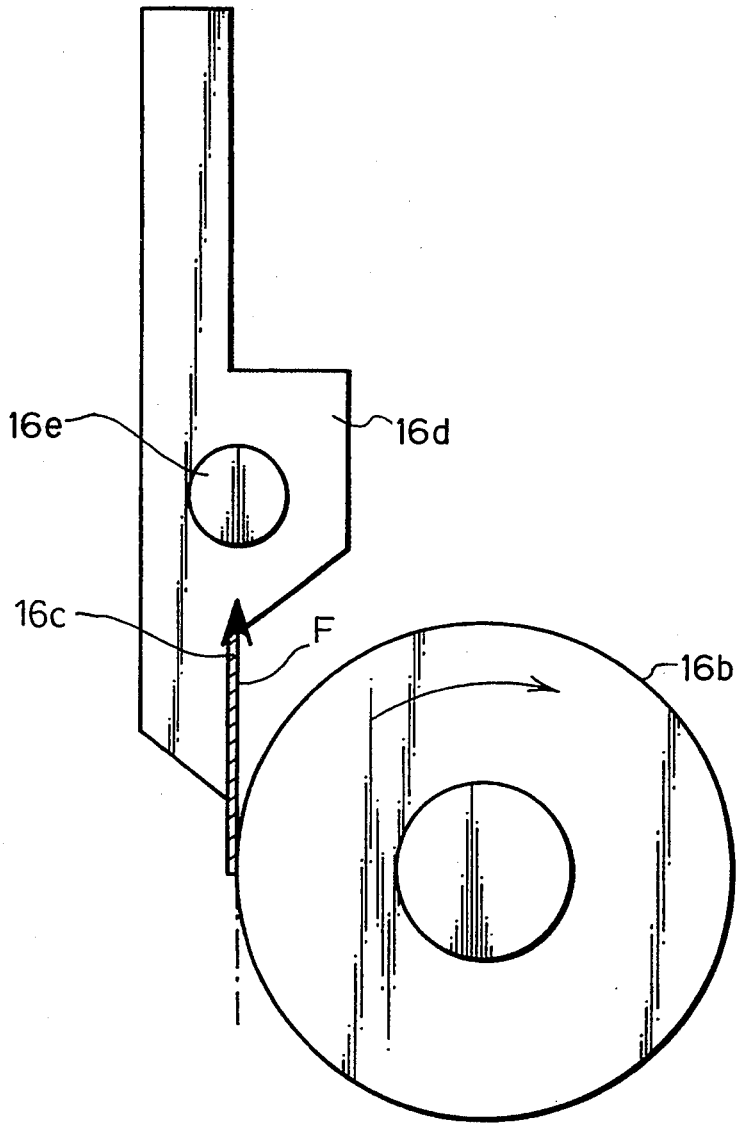
FIG. 2 is an enlarged view showing the development roller, the leaf spring member, and the rigid support member of the developing apparatus shown in FIG. 1.

According to one characteristic of the present invention, the center of rotation of the rigid support member 16d is substantially positioned on the tangent of the leaf spring member 16c and the development roller 16b, whereby occurrence of vibration of the leaf spring member 16c at the time of regulating the thickness of the toner layer can be prevented. In this embodiment, as shown in FIG. 2, when the pressing force of the coil spring 16f on the rigid support member 16d is released, the center of rotation of the rigid support member 16d, that is, the center of the shaft 16e, is positioned on the tangent of the leaf spring member 16c and the development roller 16b, so when the thickness of the toner layer is regulated, the frictional force F received by the leaf spring member 16e from the development roller 16b is oriented to the center of rotation of the rigid support member 16d, so the frictional force F does not act as a rotational moment on the rigid support member 16d and therefore the vibration of the leaf spring member 16c can be effectively prevented.

Figure 3A:
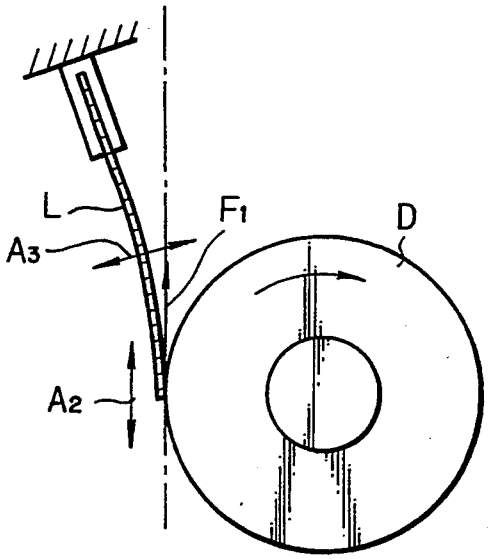
FIG. 3(*a*) and FIG. 3(*b*) are schematic views showing comparative examples of the present invention.
Figure 3B:
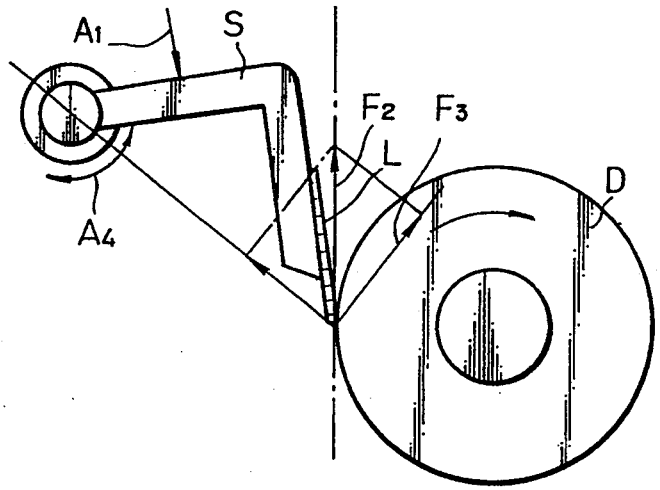

Referring to FIG. 3(*a*) and FIG. 3(*b*), comparative examples of the present invention are shown. Note that in these two figures, L indicates the leaf spring member, S the support of the leaf spring member L, and D the elastic development roller. The free end edge of the leaf spring L is chamfered to give it roundness. The leaf spring L is held by the support S so that its rounded free end edge is made to elastically press against the elastic development roller D. That is, in the example of FIG. 3(*a*), the leaf spring member L is pressed against the elastic development roller D by the spring force by the elastic deformation of the member itself. Further, in the example of FIG. 3(*b*), the support S receives an elastic deviation force from the direction indicated by the arrow $A_1$, whereby the leaf spring member L is pressed against the elastic development roller D. Even with such an arrangement and construction, during rotation of the elastic development roller D, the majority of the excess toner is removed from the toner layer successively formed there by the rounded free end edge of the leaf spring member L, then the thickness of the toner layer is regulated by the flat surface of the leaf spring member L, so the pressing force of the flat surface on the elastic development roller D may be kept relatively small, so it is possible to prevent the toner particles from being fixed on the flat surface.

However, vibration occurs at the leaf spring members L shown in FIG. 3(*a*) and FIG. 3(*b*) during the regulation of the thickness of the toner layer and the thickness of the toner layer therefore cyclically fluctuates. That is, in the example shown in FIG. 3(*a*), the leaf spring member L receives the frictional force $F_1$ in the tangential direction during the rotation of the elastic development roller D. Due to the frictional force, the free end edge of the leaf spring member L moves up and down in the direction indicated by the arrow $A_2$. Therefore, the leaf spring member L vibrates in the direction indicated by the arrow $A_3$. Further, even in the example shown in FIG. 3(*b*), the leaf spring member L receives the frictional force $F_2$ in the tangential direction during the rotation of the elastic development roller D. Due to the force component $F_3$ of the frictional force $F_2$, a rotational moment acts on the support S, whereby the support S vibrates about the axial line of rotation (arrow $A_4$). The vibration naturally affects the leaf spring member L as well. If the leaf spring member L vibrates in this way, the thickness of the toner layer fluctuates and therefore not only is the development density of the electrostatic latent image affected, but also the charge of the toner particles at the locations where the thickness of the toner layer becomes greater becomes insufficient and so-called fogging occurs.

As opposed to this, according to the present invention, as mentioned above, the center of rotation of the rigid support member 16*d* is substantially positioned on the tangent of the leaf spring member 16*c* and the development roller 16*b*, so the occurrence of vibration of the leaf spring member 16*c* can be prevented at the time of regulation of the thickness of the toner layer. Note that the term "substantially" means that if the vibration of the leaf spring member 16*c* is inhibited, the center of rotation of the rigid support member 16*d* may deviate slightly from the tangent of the leaf spring member 16*c* and the elastic development roller 16*b*. That is, as shown in FIG. 2, when the pressing force of the coil spring 16*f* on the rigid support member 16*d* is released, if the axis of rotation of the rigid support member 16*d* is positioned on the tangent of the leaf spring member 16*c* and the development roller 16*b*, the pressing force of the coil spring 16*f* affects the rigid support member 16*d*, so even if the center of rotation of the rigid support member 16*d* deviates somewhat from the tangent of the leaf spring member 16*c* and the development roller 16*b*, it is possible to prevent vibration of the leaf spring member 16*c*.

As explained above, in the developing apparatus 16 according to the present invention, vibration of the leaf spring member 16*c* is prevented when regulating the thickness of the toner layer, so the thickness of the toner layer will not fluctuate, but will be held constant and therefore a high quality developed toner image, that is, recorded toner image, can be obtained. The inventors conducted various tests to confirm this in practice. This will be explained in detail below.

Figures 4A, 4B, 4C:
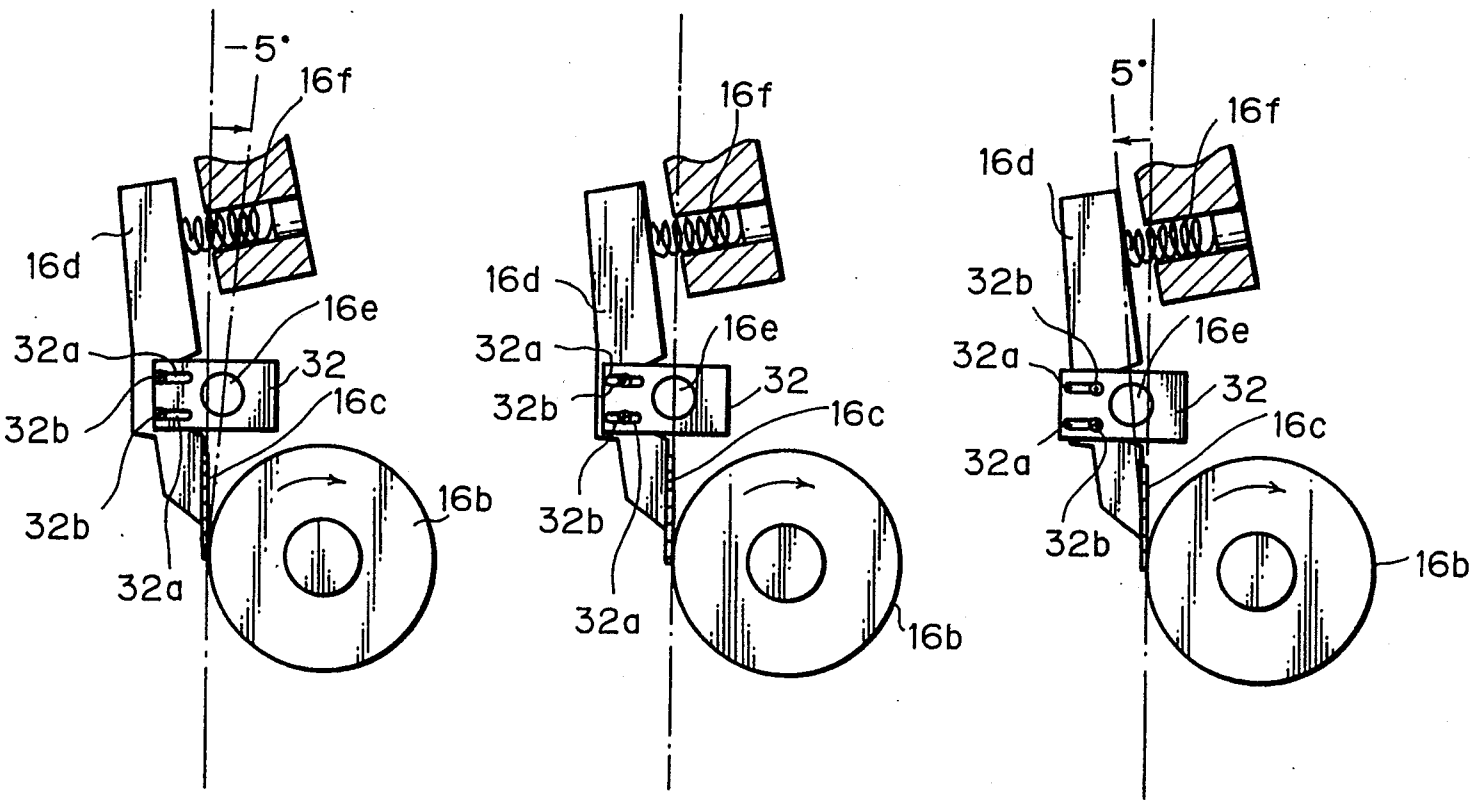
FIG. 4(*b*) is a schematic view showing the development roller, leaf spring member, and rigid support member of the developing apparatus arranged according to the present invention, while FIG. 4(*a*) and FIG. 4(*c*) are schematic views showing comparative examples of the construction of FIG. 4(*b*).

First, as shown in FIG. 4, the shaft 16*e* is supported on a mounting seat 32 displaceable in the horizontal direction, while the rigid support member 16*d* is attached to or detached from the mounting seat 32. That is, elongated holes 32*a* are formed in the mounting seat 32. Through these elongated holes 32*a*, the rigid support member 16*d* can be mounted detachably to the mounting seat 32 using stopscrews 32*b*, whereby the shaft 16*e* can be made displaceable in the horizontal direction with respect to the rigid support member 16*d*. First, as shown in FIG. 4(*b*), the rigid support member 16*d* is affixed to the mounting seat 32 so that the tangent of the leaf spring member 16*c* and the development roller 16*b* passes through the center of the shaft 16*e*. Under these conditions, the thickness of the toner layer is regulated (present invention). Next, as shown in FIG. 4(*a*), the shaft 16*e* is displaced to be far from the rigid support member 16, the rigid support member 16*d* is affixed to the mounting seat 32, and under these conditions the thickness of the toner layer is regulated. Note that in FIG. 4(*a*), the line connecting the contact point of the leaf spring member 16*c* and the development roller 16*b* and the center of the shaft 16*e* forms an angle of 5° with respect to the tangent of the leaf spring member 16*c* and the development roller 16*b*. This angle is conveniently defined as the angle of deviation −5° of the shaft 16*e*. Next, as shown in FIG. 4(*c*), the shaft 16*e* is displaced so as to approach the rigid support member 16, the rigid support member 16*d* is affixed to the mounting seat 32, and even under these conditions the thickness of the toner layer is regulated. Note that in FIG. 4(*c*), the line connecting the contact point of the leaf spring member 16*c* and the development roller 16*b* and the center of the shaft 16*e* forms an angle of 5° with respect to the tangent of the leaf spring member 16*c* and the development roller 16*b*. This angle is conveniently defined as the deviation angle 5° of the shaft 16*e*.

Figure 5:
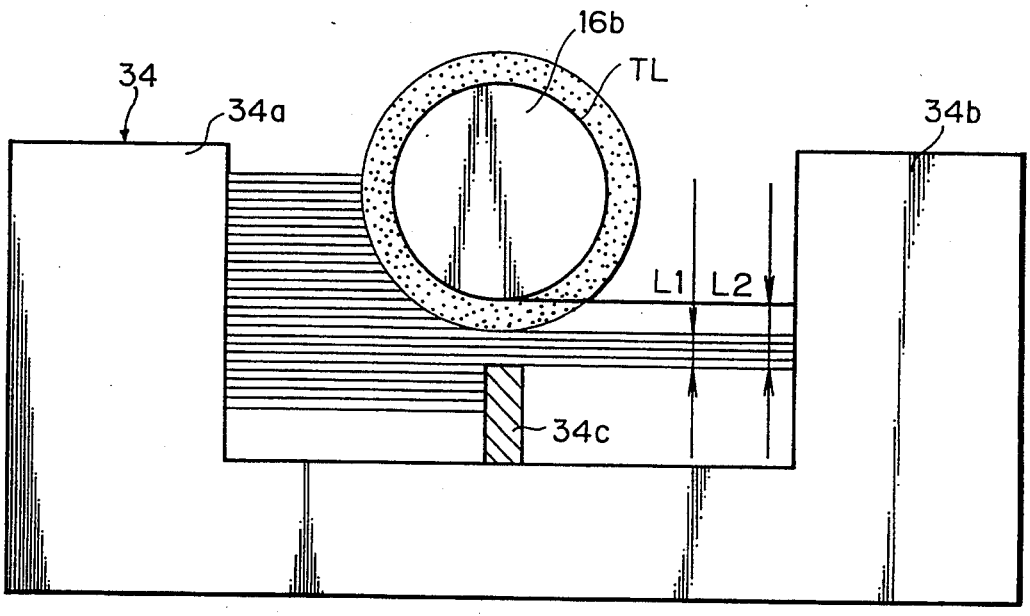
FIG. 5 is an explanatory view of a measurement method for measuring the thickness of the toner layer on the development roller by laser microscanning.

The thickness of the toner layer obtained under the conditions of each of FIG. 4(*a*), FIG. 4(*b*), and FIG. 4(*c*) was measured. The following procedures were followed for the measurement. That is:

(1) The thickness of the toner layer was regulated under the conditions of each of FIG. 4(*a*), FIG. 4(*b*), and FIG. 4(*c*), then the development roller 16*b* was gently taken out from the developing apparatus 16 and the development roller 16*b* was set on the laser scan micromeasurement apparatus 34 shown in FIG. 5. The laser scan micromeasurement apparatus 34 was provided with a light emitting unit 34*a* and the light receiving unit 34*b*. At the center location between them was disposed a reference shielding wall 34*c* for blocking part of the laser beam emitted from the light emitting unit 34*a*. In FIG. 5, the toner layer formed at the circumference of the development roller 16*b* is illustrated in an exaggerated fashion. The exaggerated toner layer is shown by the reference symbols TL. The development roller 16*b* is set with respect to the laser scan micromeasurement apparatus 34 so that the location where the thickness of the toner layer is regulated by the leaf spring member 16*c* and not reaching the photosensitive drum 10 is positioned at the top of the reference blocking wall 34*c*.

(2) In this setting, first the distance L is measured.

(3) Next, with the development roller 16*b* set in the laser scan micromeasurement apparatus 34, nitrogen gas is blown on the development roller 1*b* to completely remove the toner layer from the same, then the distance L2 is measured.

(4) Next, the thickness of the toner layer is calculated by the computation of L2–L1.

(5) The above measurement is repeated five times each under the conditions of each of FIG. 4(*a*), FIG. 4(*b*), and FIG. 4(*c*), and the mean value of the thickness of the toner layer and the variation of the measurement values are found.

Figure 6:
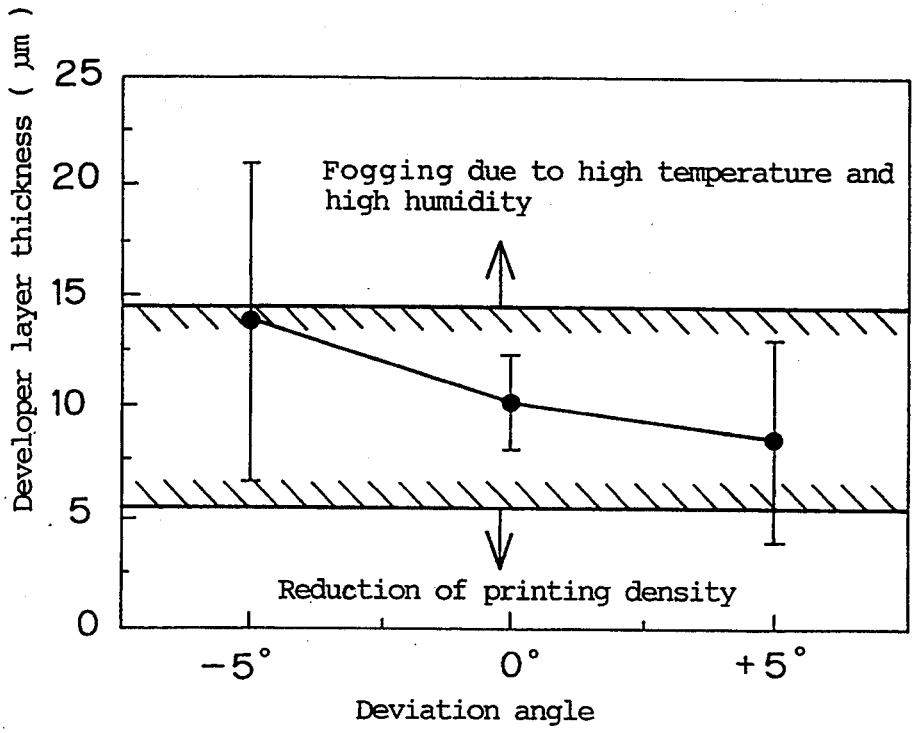
FIG. 6 is a graph showing the results of measurement in the case of measurement of the thickness of the toner layer on the development roller according to the measurement method of FIG. 5 for the cases of FIG. 4(*a*), FIG. 4(*b*), and FIG. 4(*c*).

The above results of measurement are shown in the graph of FIG. 6. As will be clear from the graph, when the deviation angle of the shaft 16e is −5° (FIG. 4(*a*)), the macroscopic toner layer average thickness is 13.8 μm and the variation 3ρ(where ρ is the standard deviation) became a large 7.3 μm. Further, when the deviation angle of the shaft 16e was +5° (FIG. 4(*c*)), the macroscopic toner layer average thickness was 8.7 μm and the variation 3ρ was 4.5 μm. When the deviation angle of the shaft 16e was 0° (FIG. 4(*b*)), that is, when the center of the shaft 16e was placed on the tangent of the leaf spring member 16c and the development roller 16b in accordance with the present invention, the macroscopic toner layer average thickness was 10.2 μm and the variation 3ρ was 2.2 μm.

Next, the state of occurrence of vibration of the leaf spring member 16c under the conditions of each of FIG. 4(*a*), FIG. 4(*b*), and FIG. 4(*c*) was observed. Note that the vibration of the leaf spring member 16c in question here is a fine one not visibly discernable, so the observation was performed indirectly by the method shown in FIG. 7. That is, the photosensitive drum 10 was removed from the developing apparatus 16, a surface potentiometer 36 was placed there, the developing apparatus 16 was operated, and the surface potential of the development roller 16b was measured, whereby it became possible to observe the state of occurrence of the vibration of the leaf spring member 16c. Note that in FIG. 7, $V_b$ shows the development bias voltage −300V applied to the development roller 16b, $V_{b1}$ is the charge implantation voltage −400V applied to the leaf spring member 16c, and $V_r$ is the voltage −400V applied to the toner reclamation and supply roller 16g.

Figure 7:
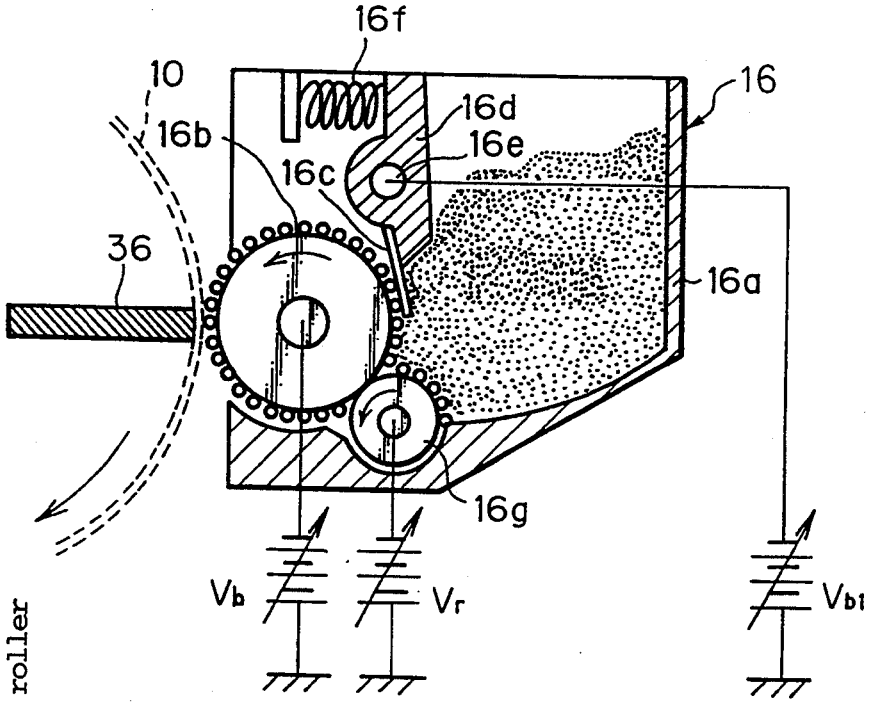
FIG. 7 is an explanatory view of the measurement method for measuring the surface potential of the development roller by a surface potentiometer in the state where the toner layer is formed on the surface of the development roller.
Figure 8:
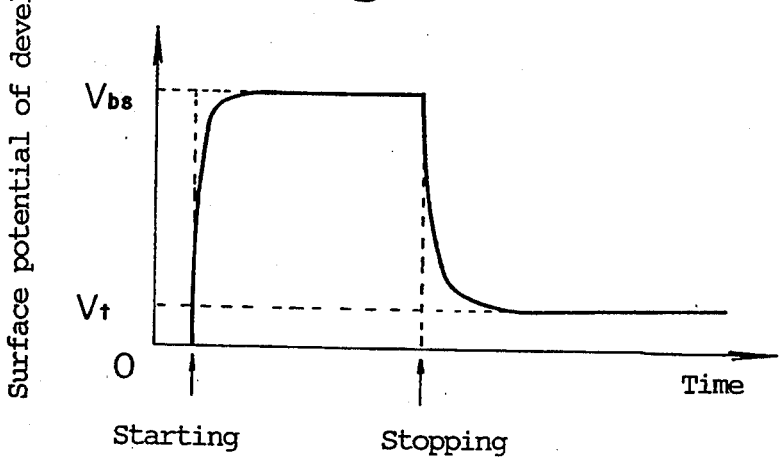
FIG. 8 is a graph for explaining the output trend of the surface potentiometer in the case of measurement of the surface potential of the development roller by the surface potentiometer in accordance with the measurement method of FIG. 7.

If it is assumed that no vibration occurs at the leaf spring member 16c, when the developing apparatus 16 of FIG. 7 is actuated and the voltages $V_b$, $V_{b1}$, and $V_r$ are applied to the development roller 16b, the leaf spring member 16c, and the toner reclamation and supply roller 16, the surface potential of the development roller 16b should immediately rise to $V_{bs}$ as shown in the graph of FIG. 8, then stabilize there. This is because the leaf spring member 16c just is made to contact the development roller 16b through a toner layer of a predetermined thickness, so the surface potential $V_{bs}$ must depend on the certain development bias voltage $V_b$ applied to the development roller 16b and the potential $V_1$ of the toner layer. As opposed to this, if it is assumed that vibration occurs in the leaf spring member 16c, that is, if it is assumed that the leaf spring member 16c vibrates continuously with respect to the thin toner layer on the development roller 16b, during the vibration, a substantially direct state of contact can occur locally between the leaf spring member 16c and the development roller 16b. At that time, not only the development bias voltage, but also part of the charge implantation voltage is applied to the development roller 16b, so the surface potential $V_{bs}$ becomes extremely unstable in state. Note that if the operation of the developing apparatus 16 is stopped and $V_b$, $V_{b1}$, and $V_r$ return to the ground level (zero volts), the surface potential should swiftly fall from $V_{bs}$ to the potential $V_t$ of the toner layer.

Figures 9A, 9B, 9C:
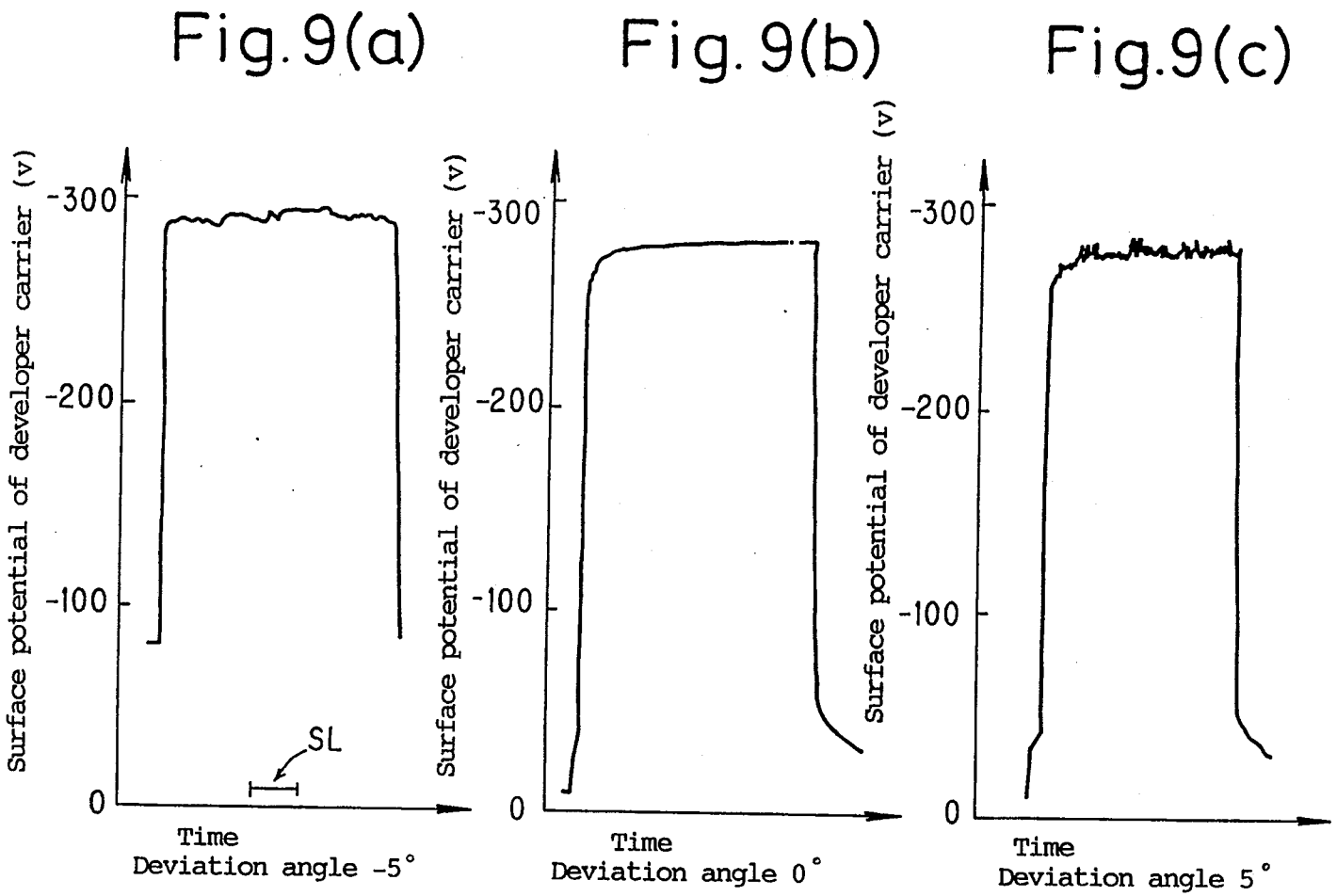
FIG. 9(*a*), FIG. 9(*b*), and FIG. 9(*c*) are graphs showing the results of measurement when actually measuring the surface potential of the development roller in accordance with the measurement method of FIG. 8 for each of the cases of FIG. 4(*a*), FIG. 4(*b*), and FIG. 4(*c*).

The results of measurement of the surface potential of the development roller 16b under the conditions of each of FIG. 4(*a*), FIG. 4(*b*), and FIG. 4(*c*) are shown in FIG. 9. Note that in FIG. 9(*a*), the standard length shown by the arrow SL corresponds to 10 seconds. This is the same for FIG. 9(*b*) and FIG. 9(*c*). As clear from each of the graphs of FIG. 9(*a*) and FIG. 9(*c*), when the deviation angle of the shaft 16e is −5° and the deviation angle of the shaft 16e is +5°, the surface potential of the development roller 16b is unstable at the peak region. This shows that vibration is occurring at the leaf spring member 16c. As opposed to this, under the conditions of FIG. 4(*b*) (present invention), when the deviation angle of the shaft 16e is 0°, the surface potential of the development roller 16b stabilizes at the peak region. This shows that no vibration occurs at the leaf spring member 16c.

When the deviation angle of the shaft 16e is −5°, when the leaf spring member 16c receives frictional force in the tangential direction from the development roller 16b, one of the force components acts to separate the leaf spring member 16c from the development roller 16b. The leaf spring member 16c is made to vibrate by this separating action. Due to this vibration of the leaf spring member 16b, the regulating force on the thickness of the toner layer becomes weaker, so the thickness of the toner layer becomes relatively larger. This matches with the results of the graph of FIG. 6. That is, along with the increase in the thickness of the toner layer, the average charge of the toner particles falls. This means that there are even toner particles close to an uncharged state in the toner particles. These uncharged toner particles cause fogging. In actuality, when a recording operation was performed under a high temperature and high humidity (40° C., relative humidity of 80 percent RH) environment with the deviation angle of the shaft 16e set to −5°, fogging of an optical reflection density (OD) of over 0.04 occurred on the recording paper. Fluctuations also occurred in the recording density. The quality of the recorded toner image was inferior.

Further, when the deviation angle of the shaft 16e was +5°, when the leaf spring member 16c received the frictional force in the tangential direction from the development roller 16b, one of the force components acted to cause the leaf spring member 16c to bite into the development roller 16b. Due to this biting action, the leaf spring member 16c vibrated. Due to this vibration of the leaf spring member 16c, the regulating force on the thickness of the toner layer grew stronger, so the thickness of the toner layer became relatively smaller. This matches with the results of the graph of FIG. 6. When the recording operation was actually performed with the deviation angle of the shaft 16e set to +5°, however, fogging with an optical reflection density (OD) of over 0.04 occurred on the recording paper. This result appears to contradict the above explanation, but regarding the occurrence of fogging, it is guessed that the leaf spring member 16c bites into the development roller 16b, then immediately the leaf spring member 16c rebounds from the development roller 16b and, at this time, the thickness of the toner layer becomes greater and the average charge of that portion of the toner particles drops.

When the deviation angle of the shaft 16e is 0 (present invention), the vibration of the leaf spring member 16c is suppressed and the development can be stably performed. The quality of the recorded toner image actually obtained was excellent. That is, the recorded density (OD) measured using an optical reflection densitometer was 1.4. The unevenness of density (OD) was also a small 0.1 or less. Further, the density of the fogging of the background portion on the recording paper was indiscernible (fogging density OD ≦0.01).

Figure 10C:
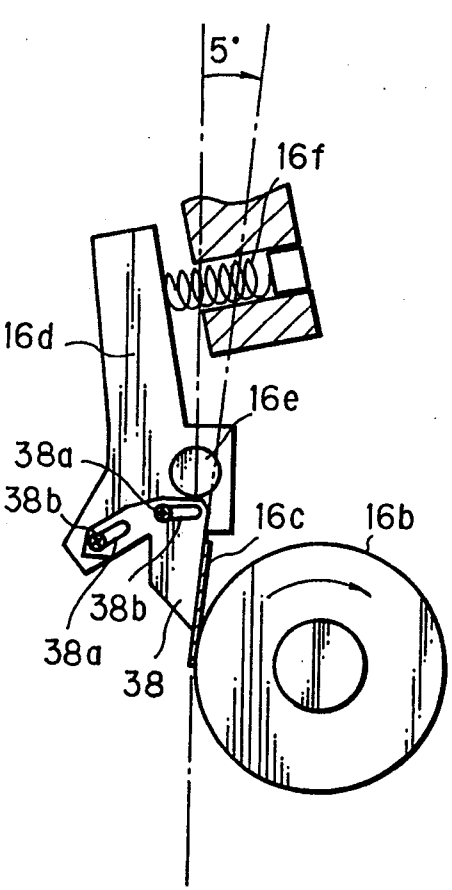
FIG. 10(*b*) is a schematic view showing the development roller, leaf spring member, and rigid support member of the developing apparatus arranged according to the present invention, while FIG. 10(*a*) and FIG. 10(*c*) are schematic views showing comparative examples of the construction of FIG. 10(*b*).
Figure 10B:
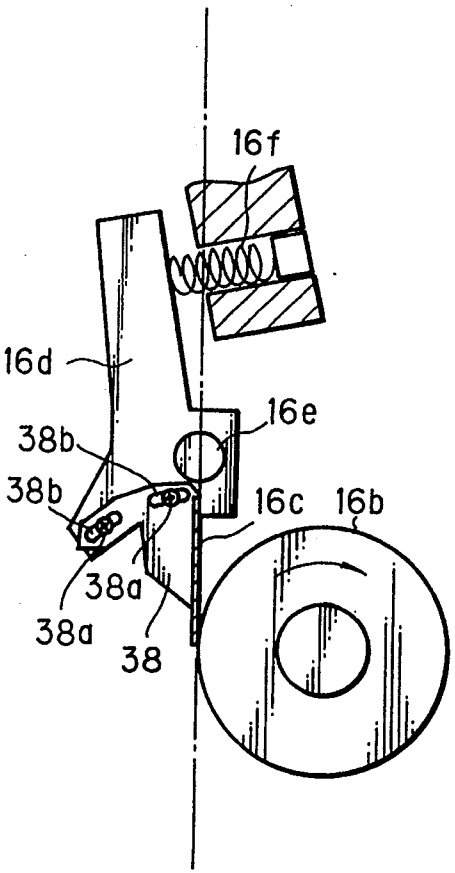
Figure 10A:
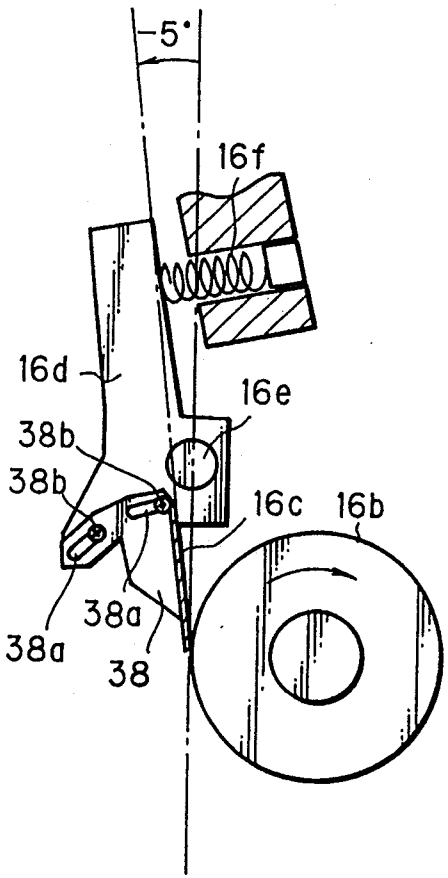

In the example shown in FIG. 4, the leaf spring member 13*c* was fixed in place and the position of the shaft 16*e* was changed. A similar experiment was performed for the case where the shaft 16*e* was fixed in place and the setting angle of the leaf spring member 16*c* was changed. That is, as shown in FIG. 10, the rigid support member 16*d* was rotatably attached to the shaft 16*e* fixed to a predetermined position, and the leaf spring member 16*c* was supported at the rigid support member 16*d* through a variable-angle mounting seat 38. Explained in more detail, the leaf spring member 16*c* is supported by the mounting seat 38 and the mounting seat 38 is attached detachably to the rigid support member 16*d* by passing stopscrews 38*b* through the elongated holes 38*a* formed there. By this, the angular position of the leaf spring member 16*c* is made freely adjustable. First, as shown in FIG. 10(*b*), the angular position of the leaf spring member 16*c* is set so that the tangent of the leaf spring member 16*c* and the development roller 16*b* passes through the center of the shaft 16*e*. Under these conditions, the thickness of the toner layer was regulated (present invention). Next, as shown in FIG. 10(*a*), the mounting seat 38 was angularly displaced in the counterclockwise direction and the thickness of the toner layer was regulated under those conditions as well. Note that in FIG. 10(*a*), the line connecting the contact point between the leaf spring member 16*c* and the development roller 16*b* and the shaft 16*e* forms an angle of 5° with respect to the tangent of the leaf spring member 16*c* and the development roller 16*b*. This angle is conveniently defined as the displacement angle −5° of the leaf spring member 16*c*. Further, as shown in FIG. 10(*c*), the mounting seat 38 is angularly displaced in the clockwise direction and the thickness of the toner layer was regulated under these conditions as well. Note that in FIG. 10(*c*), the line connecting the contact point between the leaf spring member 16*c* and the development roller 16*b* and the center of the shaft 16*e* forms an angle of 5° with respect to the tangent of the leaf spring member 16*c* and the development roller 16*b*. This angle is conveniently defined as the displacement angle +5° of the leaf spring member 16*c*.

Figure 11:
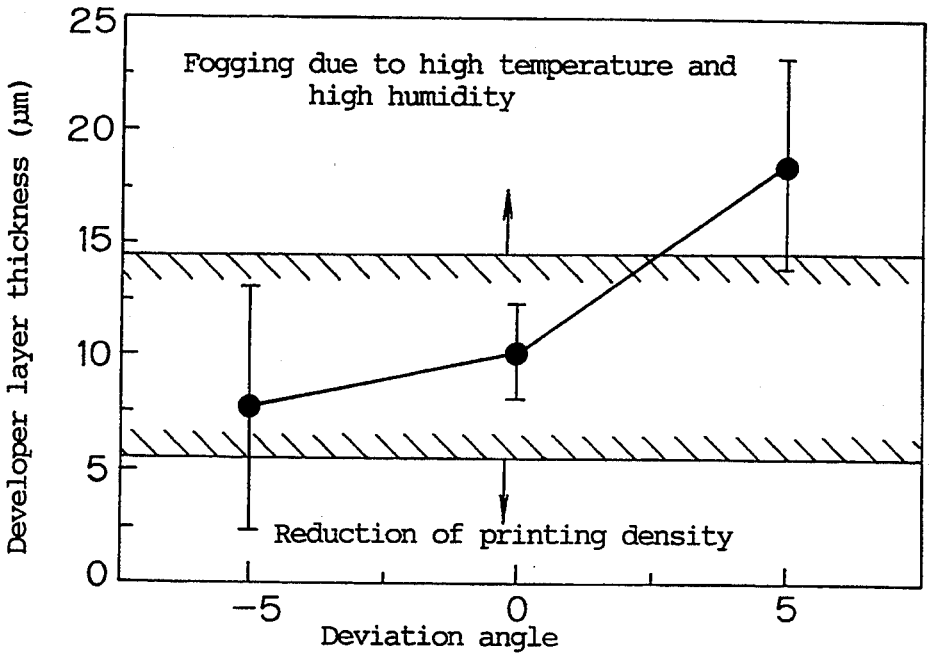
FIG. 11 is a graph showing the results of measurement in the case of measurement of the thickness of the toner layer on the development roller according to the measurement method of FIG. 5 for the cases of FIG. 10(*a*), FIG. 10(*b*), and FIG. 10(*c*).
Figures 12A, 12B, 12C:
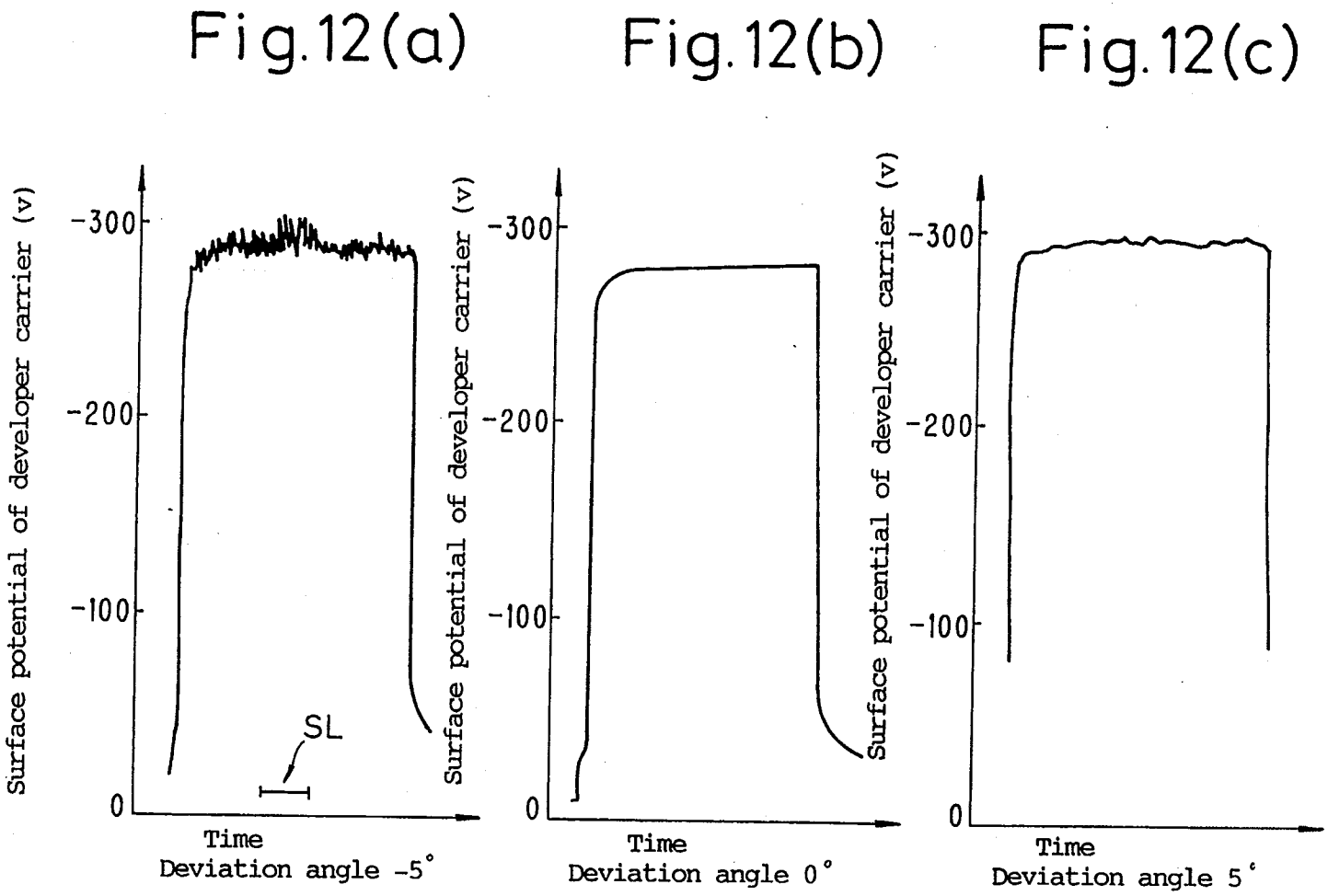
FIG. 12(*a*), FIG. 12(*b*), and FIG. 12(*c*) are graphs showing the results of measurement when actually measuring the surface potential of the development roller in accordance with the measurement method of FIG. 8 for each of the cases of FIG. 10(*a*), FIG. 10(*b*), and FIG. 10(*c*).

The thickness of the toner layer was measured under the conditions of each of FIG. 10(*a*), FIG. 10(*b*), and FIG. 10(*c*). The thicknesses were measured under the same conditions as the case of FIG. 4(*a*), FIG. 4(*b*), and FIG. 4(*c*). The results are shown in FIG. 11. Further, by the same method as shown in FIG. 7, the surface potential of the development roller 16*b* was also measured under the conditions of each of FIG. 10(*a*), FIG. 10(*b*), and FIG. 10(*c*). The results are shown in FIG. 12. Note that in FIG. 12(*a*), the standard length shown by the arrow SL corresponds to 10 seconds. The same applies to FIG. 12(*b*) and FIG. 12(*c*).

When the deviation angle of the leaf spring member 16*cm* is −5°, as clear from the graph of FIG. 11, the macroscopic toner layer average thickness is 7.8 μm and the variation 3ρ became a large 6.2 μm. When an actual recording operation was performed, unevenness of density of an optical reflection density (OD) of less than 1.3 occurred at the recorded toner image. Further, the optical reflection density (OD) of the fogging became over 0.03, to the extent that the background area of the recording paper was blackened. On the other hand, as shown in FIG. 12(*a*), the surface potential of the development roller 16*b* fluctuated violently at the peak region. This closely resembles the case of FIG. 9(*c*). In short, it is believed that, when the deviation angle of the leaf spring member 16*c* was made −5°, in the same way as in the case of FIG. 9(*c*), the leaf spring member 16*c* received the frictional force in the tangential direction from the development roller 16*b* and one of the force components acts to cause the leaf spring member 16*c* to bite into the development roller 16*b*, whereby the leaf spring member 16*c* vibrates.

When the deviation angle of the leaf spring member 16*c* was +5°, the macroscopic toner layer average thickness was 18.4 μm and the variation 3ρ was a large 4.6 μm. When an actual recording operation was performed, unevenness of the density was seen in the recorded toner image and fogging with an optical reflection density (OD) of less than 0.04 occurred. On the other hand, as shown in FIG. 12(*c*), even the surface potential of the development roller 16*b* is unstable at the peak region. This closely resembles the case of FIG. 9(*a*). In short, in the same way as the case of FIG. 9(*a*), it is believed that the leaf spring member 16*c* receives the frictional force in the tangential direction from the development roller 16*b* and one of the force components acts to separate the leaf spring member 16*c* from the development roller 16*b*, whereby the leaf spring member 16*c* vibrates.

When the displacement angle of the leaf spring member 16*c* is 0° (present invention), the macroscopic toner layer average thickness is 10.2 μm and the variation 3ρ is 2.2 μm. Even in an actual recording operation, an optical reflecting density (OD) of 1.4 was obtained as the printing density. The unevenness of the density was also a small 0.1 or less. Further, the fogging density of the background portion of the recording paper was of an indiscernible extent (fogging density OD ≦0.01).

As explained above, the front edge of the protecting edge of the leaf spring member 16*c* is chamfered to give it roundness, and the radius of the rounded front end is made, for example, 0.05 mm in this embodiment. The radius of this rounded front edge can also be an important factor in obtaining an excellent quality recorded toner image. Therefore, the following experiment was conducted on the relationship of the radius R of the rounded front edge and the quality of the recorded toner image.

Four leaf spring members were prepared from a stainless steel sheet material of a thickness of 0.2 mm (SUS 631-CSP-4/3H). Among these, three leaf spring members were chamfered at one of their respective end portions by a super grindstone to give radii of the rounded front end portions of R=0.10 mm, R=0.07 mm, and R =0.03 mm. The remaining one leaf spring member was not chamfered. Using these four types of leaf spring members, actual recording was performed on recording paper and the quality of the recorded toner image was evaluated. The experiment is summarized below:

(1) The center of the shaft 16*e* of the rigid support member 16*d* was positioned on the tangent of the leaf spring members and the development roller 16*b*.

(2) The leaf spring members were pressed into contact with the development roller 16*b* at a linear pressure of 40 gf/cm.

(3) The development processes were performed under an environment where fogging easily occurs, that is, a temperature of 40° C. and a relative humidity of 80 percent RH.

(4) In the development processes, parallel hatching line pattern development comprised of a large number of one-dot hatching lines at an angle of 45° (pitch between hatching lines in horizontal direction: 8 dots) and all-white development (no exposure of photosensitive drum 10) were performed. The developed toner images were transferred to recording paper (A4 size) and fixed there. Note that in the all-white development, of course, there was no developed toner image to be transferred from the photosensitive drum 10 to the recording paper.

(5) For the evaluation, the first recorded toner image and the toner image recorded on the 20,000th recording sheet were selected.

Figure 13:
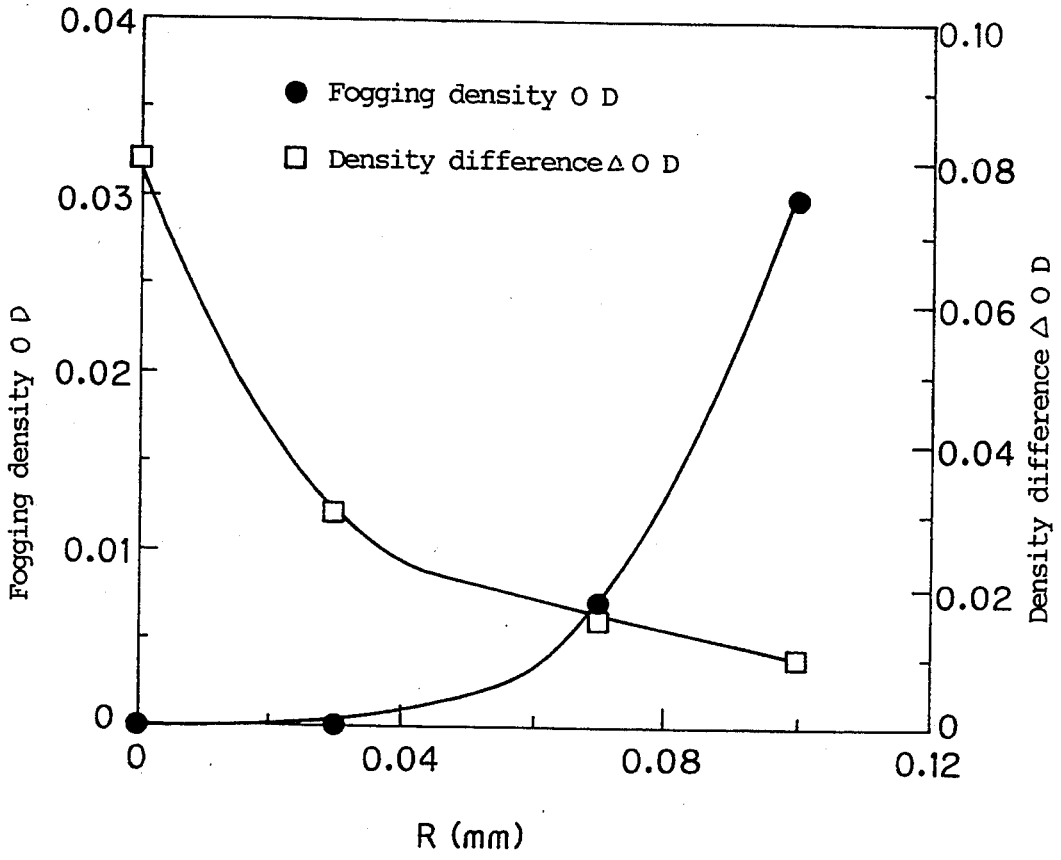
FIG. 13 is a graph showing the relationship between the radius of the rounded front edge of the leaf spring member and the recording quality.

The results of the evaluation are shown in the graph of FIG. 13. Note that the horizontal axis of the graph shows the radius R of the rounded front edge of the leaf spring member, while the right vertical axis shows the difference between the maximum value (black streak) and minimum value (white streak) of the average optical reflection density OD of a region of a diameter of 4 mm of the parallel hatching line pattern recording and the left vertical axis shows the value of the fogging density of the all-white recording measured by an optical reflection densitometer. As clear from this graph, in parallel hatching line pattern recording in the case using the leaf spring member not given a rounded front edge (R=0), the difference of the average recording densities was a large 0.08. This was far higher than the visually discernible density difference 0.03. Black streaks and white streaks of uneven density were observed on the recording paper. As opposed to this, in the case of the leaf spring members chamfered to give them roundness (R=0.10 mm, R=0.07 mm, and R=0.03 mm), the difference in density could be held to below 0.03, it was learned. Further, in the all-white recording performed under the high temperature and high humidity (40° C./80 percent RH) environment, when use was made of the leaf spring member with R=0.10 mm, the visually discernible limit of a difference of density of 0.01 (value minus optical reflection density (OD) of recording paper) was exceeded and fogging easily occurred, it was learned. In short, when chamfering the front edge of the protruding end of the leaf spring member (**16*b*** ), the radius R should be made one within the following range, it was learned:

$0.03\ \text{mm} \leqq R \leqq 0.07\ \text{mm}$

Figure 14A:
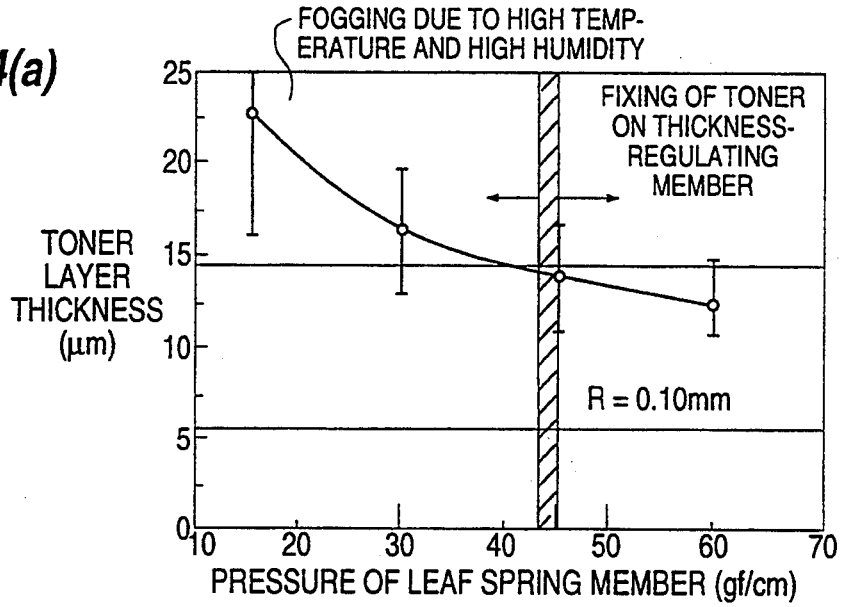
FIG. 14(*a*), FIG. 14(*b*), and FIG. 14(*c*) are graphs showing the relationship between the press-contact force of the leaf spring member to the development roller and the thickness of the toner layer and the relationship with the radius of the rounded front end of the leaf spring member.
Figure 14B:
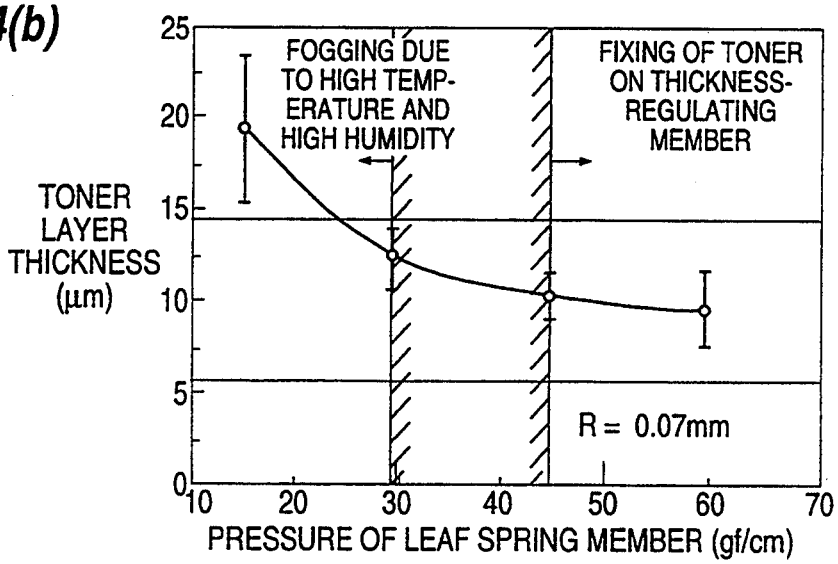
Figure 14C:
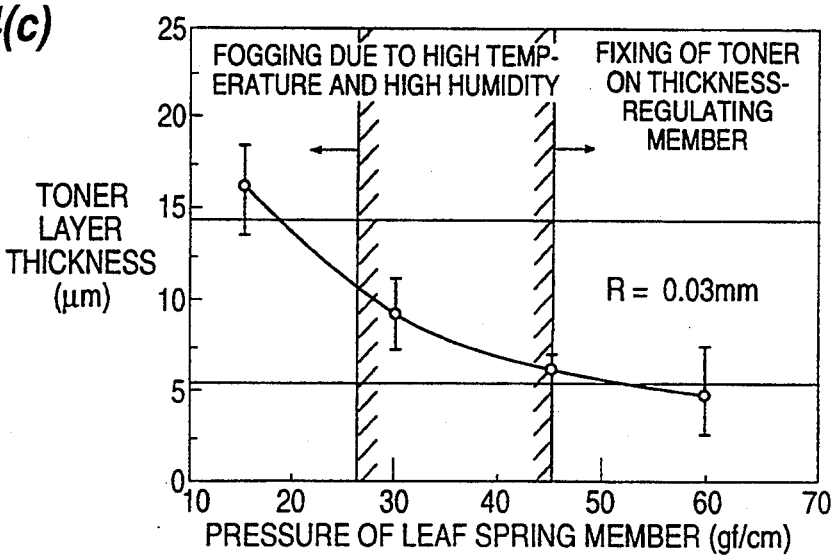

Further, an experiment was also performed on the three types of leaf spring members (R=0.10 mm, R=0.07 mm, R=0.03 mm) which were chamfered so as to see how the thickness of the toner layer changes in the case of changing the linear pressure with respect to the development roller **16*b* (that is, the pressure regulating the thickness of the toner layer). The results are shown in the graph of FIG. 14. As clear from the graph, as a general trend, as the radius R of the rounded front edge of the leaf spring member becomes smaller, the thickness of the toner layer can be kept thin by a much smaller linear pressure, it is learned. For example, a look at the upper limit (0.07 mm) of the radius R of the rounded front edge of the leaf spring member shows that a linear pressure of at least 30 gf/cm is required with respect to the development roller 16*b*. Further, the three chamfered types of leaf spring members were evaluated as to the quality of the recorded toner image after setting the linear pressures with respect to the development roller 16*b* to 12 gf/cm, 30 gf/cm, 45 gf/cm, and 60 gf/cm and performing a running recording test of 20,000 sheets of recording paper (A4 size) the same as in the above case. As a result, with a linear pressure of 60 gf/cm, with all the leaf spring members, the toner particles were fixed in a crushed manner and black streaks and white streaks of a maximum density difference of 0.16 occurred in the parallel hatching line pattern recording. From the above, it was learned that the linear pressure of the leaf spring member 16*c* with respect to the development roller 16*b*** is preferably within the range of about 30 gf/cm to about 45 gf/cm.

Figure 15:
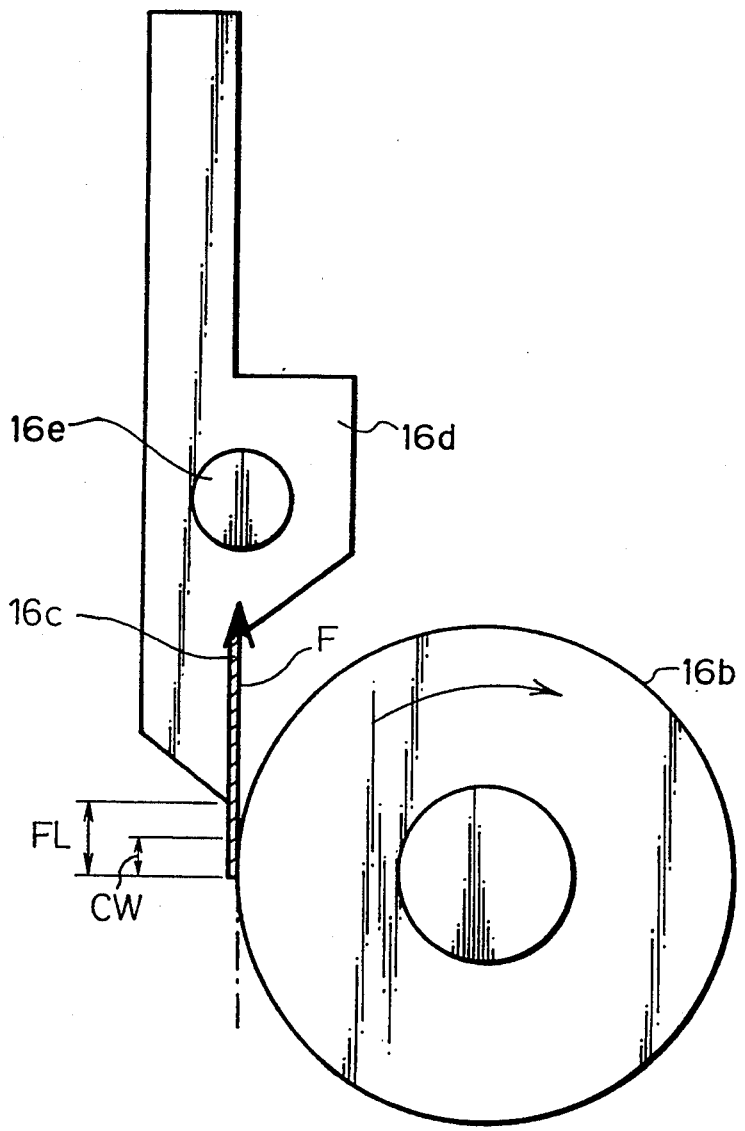
FIG. 15 is an enlarged view showing the development roller, leaf spring member, and rigid support member taken out of the developing apparatus shown in FIG. 1, which view explains other characteristics of the present invention.

Further, in the present invention, as shown in FIG. 15, it was confirmed by the following experiment that the flexible length FL of the protruding end of the leaf spring member **16*c* (that is, the distance from the front end of the rigid support member 16*d* to the rounded front edge of the leaf spring member 16*c***) is closely related to the regulation of the thickness of the toner layer.

Figure 16:
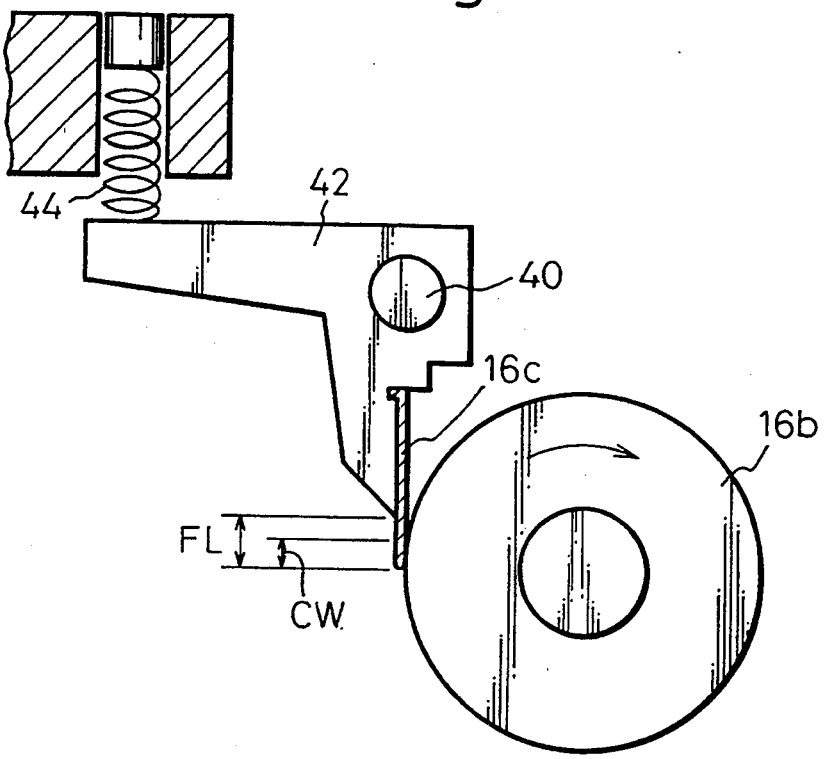
FIG. 16 is a schematic view showing a support apparatus for the leaf spring member constituted so as to enable replacement of the rigid support member of the leaf spring member in the developing apparatus.
Figure 17:
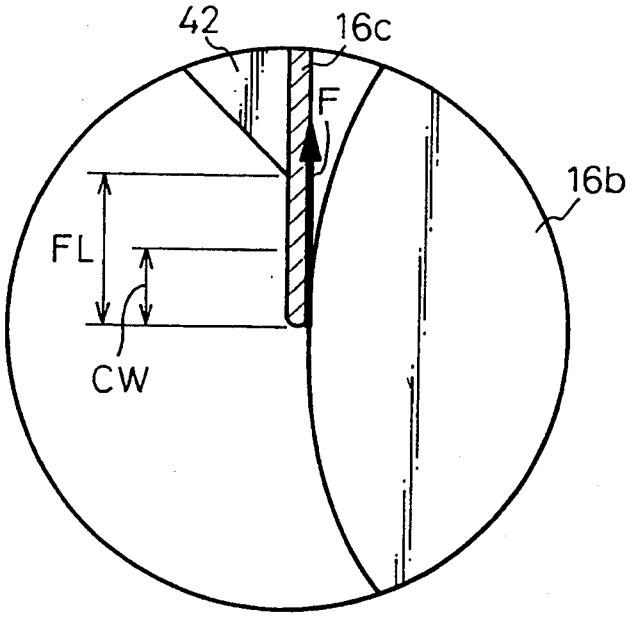
FIG. 17 is a partial enlarged view showing an enlargement of the contact portion between the leaf spring member of the support apparatus shown in FIG. 16 and the development roller.

First, before the experiment, a support apparatus of the leaf spring member **16*c* as shown in FIG. 16 was prepared. This support apparatus is provided with a fixed shaft 40 arranged at a predetermined position and a rigid support member 42 detachably attached to the shaft 40. The leaf spring member 16*c* is supported in the same way as in the case of the rigid support member 16*d* on the rigid support member 42. A coil spring 44 is made to act on the rigid support member 42, whereby the leaf spring member 16*c* is elastically pressed against the development roller 16*b* with a predetermined pressure. The center of rotation of the rigid support member 42, that is, the center of the fixed shaft 40, is positioned on the tangent between the leaf spring member 16*c* and the development roller 16*b* . Therefore, the frictional force F acting on the leaf spring member 16*c* (FIG. 17) is oriented toward the center of the shaft 40, so a force component causing vibration of the leaf spring member 16*c* is never created from the frictional force F. That is, the support apparatus shown in FIG. 16 is equivalent to the leaf spring member support apparatus shown in FIG. 1**.

At the time of the experiment, four types of rigid support members $\mathbf{42}_1$, $\mathbf{42}_2$, $\mathbf{42}_3$, and $\mathbf{42}_4$ as illustrated in FIG. 18, FIG. 19, FIG. 20, and FIG. 21, respectively, were prepared. Leaf spring members **16*c* of the same dimensions were attached to these rigid support members, but the lengths of the support arm portions of the rigid support members, that is, the portions supporting the leaf spring member 16*c*, were different. That is, in FIG. 18, the distance from the center of rotation of the rigid support member $\mathbf{42}_1$ to the front end of the support arm portion is made 23 mm and the length of the protruding end of the leaf spring member 16*c* protruding from the front end, that is, the flexible length FL, is made 2 mm. Further, in FIG. 19, the distance from the center of rotation of the rigid support member $\mathbf{42}_2$ to the front end of the support arm portion is made 22 mm and the flexible length FL of the leaf spring member 16*c* is made 4 mm. Further, in FIG. 21, the distance from the center of rotation of the rigid support member $\mathbf{42}_4$ to the front end of the support arm portion is made 20 mm and the flexible length FL of the leaf spring member 16*c* is made 5 mm. Note that the contact width CW (FIG. 15) between the leaf spring member 16*c* and the development roller 16*b*** was made 2.4 mm.

Figure 22:
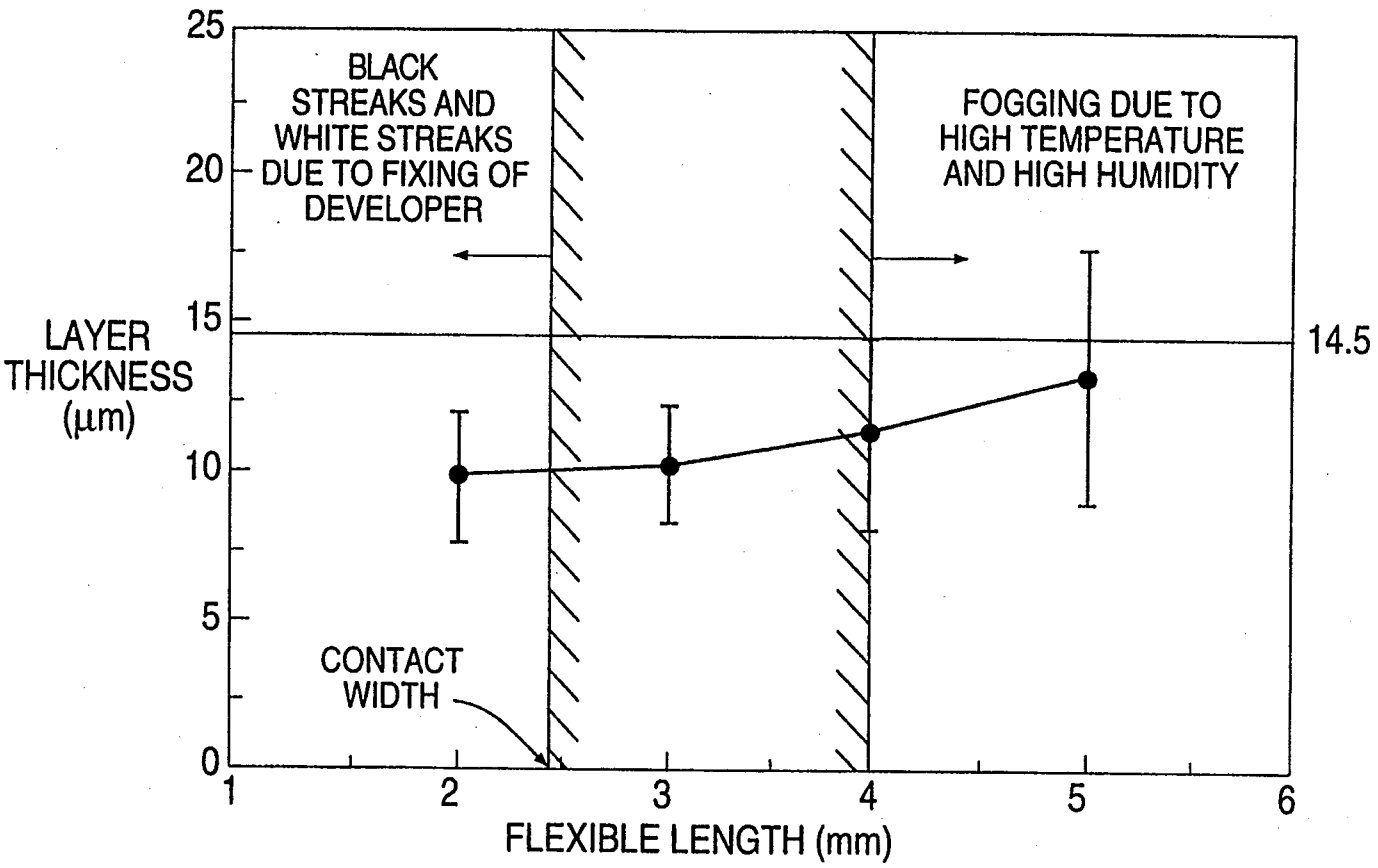
FIG. 22 is a graph showing the results of measurement in the case of measurement of the thickness of the toner layer on the development roller according to the measurement method of FIG. 5 for the cases of the flexible lengths of the leaf spring members shown in FIG. 18 to FIG. 21.

The thickness of the toner layer was regulated under the conditions of each of FIG. 18, FIG. 19, FIG. 20, and FIG. 21, then the thickness of the toner layer was measured by the laser scan micromeasurement apparatus 34 of FIG. 5. Note that the measurement of the thickness of the toner layer under the conditions of each of FIG. 18, FIG. 19, FIG. 20, and FIG. 21 was repeated five times. The results of the measurements are shown in the graph of FIG. 22. As is clear from the graph, when the flexible length FL of the leaf spring member 16*c* is made 5 mm (FIG. 21), the macroscopic average thickness of the toner layer became a relatively thick 12.7 μm and the variation ρ (where ρ is the standard deviation) became a large 5.4 μm. As the factors for this, it may be considered that if the flexible length of the leaf spring member 16*c* increases, the flexibility increases, so the thickness-regulating force of the toner layer becomes weaker and vibration becomes easy to occur and, further, not only the macroscopic average thickness of the toner layer, but also the variation of the same become larger. As clear from the graph of FIG. 22, if the variation becomes 5.4 μm, the thickness of the toner layer often exceeds the upper limit of 14.5 μm for maintaining an excellent quality of the developed toner image. When the thickness of the toner layer exceeds the upper limit of 14.5 μm, the average toner charge falls and as a result fogging easily occurs.

Figure 18:
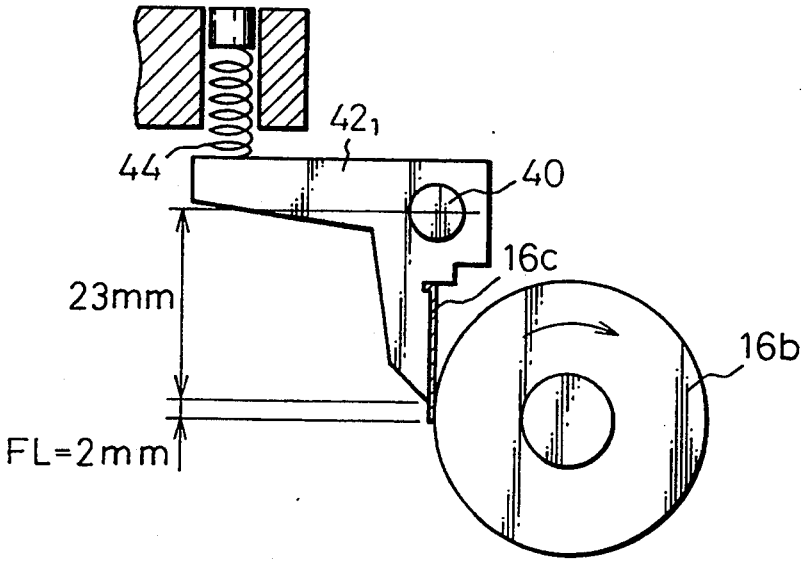
FIG. 18 is a schematic view of the attachment of the rigid support member supporting the leaf spring member to the support apparatus shown in FIG. 16 so that the flexible length of the leaf spring member becomes 2 mm.
Figure 19:
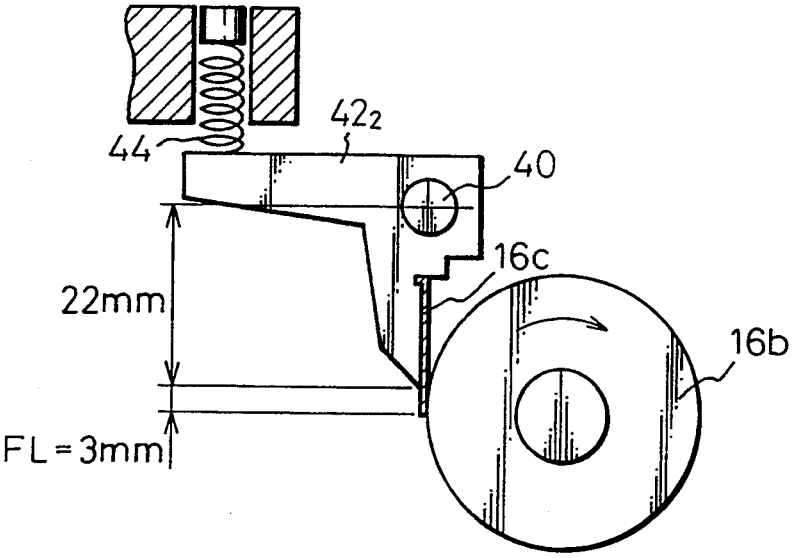
FIG. 19 is a schematic view of the attachment of the rigid support member supporting the leaf spring member to the support apparatus shown in FIG. 16 so that the flexible length of the leaf spring member becomes 3 min.
Figure 20:
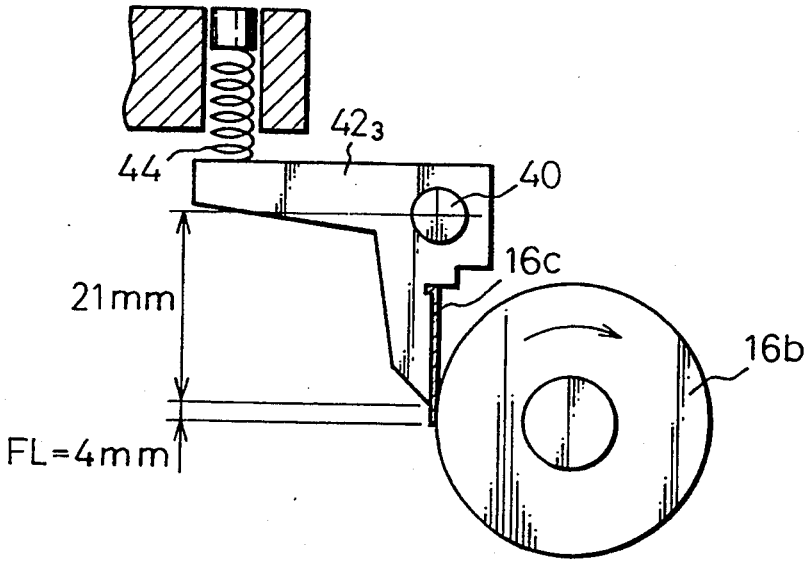
FIG. 20 is a schematic view of the attachment of the rigid support member supporting the leaf spring member to the support member shown in FIG. 16 so that the flexible length of the leaf spring member becomes 4 mm.
Figure 21:
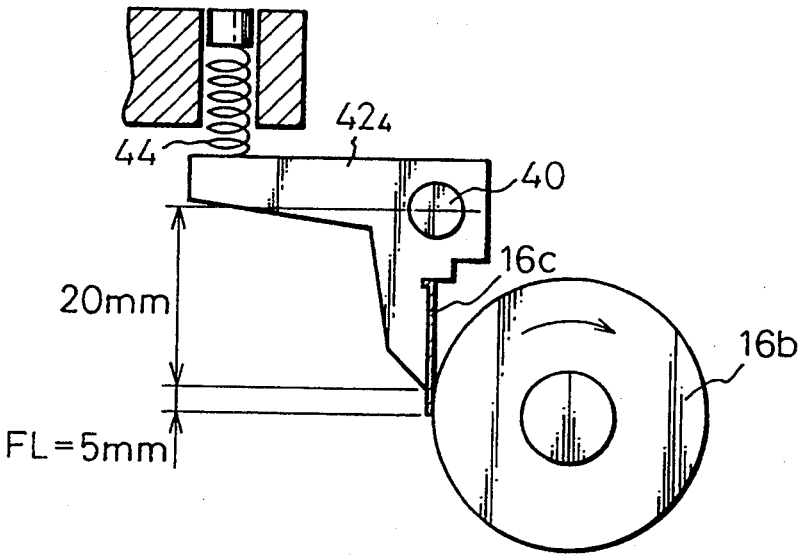
FIG. 21 is a schematic view of the attachment of the rigid support member supporting the leaf spring member to the support member shown in FIG. 16 so that the flexible length of the leaf spring member becomes 5 mm.
Figure 23:
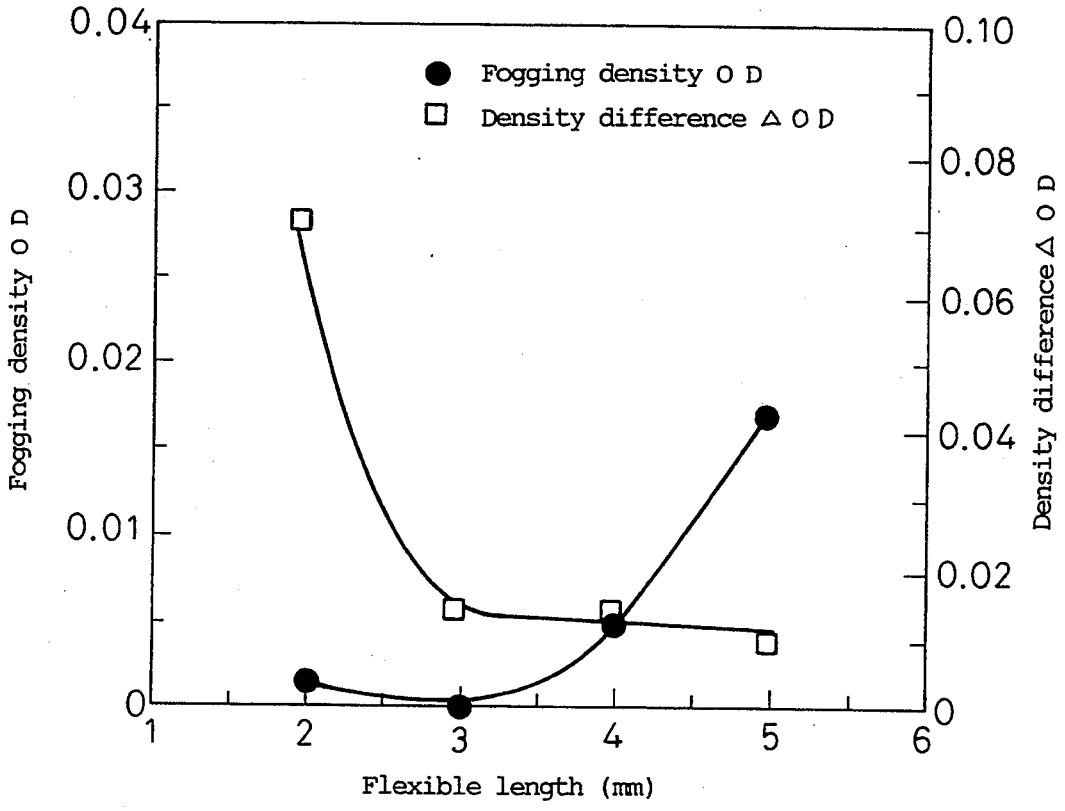
FIG. 23 is a graph showing the evaluation of the recording quality when making a running recording of 20,000 sheets of recording paper for each of the cases of the flexible lengths of the leaf spring members of FIG. 18 to FIG. 21.

Next, running recording was performed of 20,000 sheets of recording paper (A4 size) under the conditions of each of FIG. 18 to FIG. 20 to evaluate the recording quality. At this time, parallel hatching line pattern recording comprised of a large number of one-dot hatching lines at an angle of 45° (pitch between hatching lines in horizontal direction: 8 dots), all-white recording (no exposure of photosensitive drum 10) and all-black recording (complete exposure of photosensitive drum 10) were performed on the recording sheets. For the evaluation, the recording on the first sheet and the recording on the 20,000th recording sheet were selected. The results of the evaluation are shown in the graph of FIG. 23. Note that in the graph, the whited out squares show the density difference ΔOD between the maximum value (black streaks) and minimum value (white streaks) of the average optical reflection density (OD) of a 4 mm diameter region for the parallel hatching pattern, while the black circles show the fogging density (OD) measured by an optical reflection densitometer in all-white recording. As clear from the graph of FIG. 23, when the flexible length of the leaf spring member 16*c* becomes less than 3 mm, the density difference ΔOD rapidly increases, it was learned. Only when the flexible length of the leaf spring member 16*c* is 2 mm (FIG. 18) are black streaks and white streaks of a large density difference ΔOD of 0.08 observed in the parallel hatching pattern recording. This density difference ΔOD 0.08 is larger than the visually discernable density difference ΔOD of 0.03. Therefore, when the developing apparatus was disassembled and the causes investigated, it was found that toner particles had deposited on the thickness-regulating surface of the leaf spring member 16*c* and that the locations of deposition of the toner particles matched the front end of the support arm portion of the rigid support member $42_1$ positioned at the back side of the thickness-regulating surface. As the reason for this, since the flexible length of the leaf spring member 16*c* is short, the flexibility becomes smaller. Further, the front end of the support arm portion of the rigid support member $42_1$, as clear from FIG. 18, is positioned in the contact area (CW=2.4 mm)between the leaf spring member 16*c* and the development roller 16*b*. Therefore, during the running recording of 20,000 sheets of recording paper, the protruding end of the leaf spring member 16*c* is bent so as to become slightly separated from the development roller by the toner particles pushed between that end and the development roller 16*b* and thus the toner particles are crammed between them. That is, it is believed that the crammed toner particles are crushed against the thickness-regulating surface of the leaf spring member 16*c* and become affixed there.

On the other hand, when the flexible length FL of the protruding end of the leaf spring member 16*c* is less than 4 mm and more than the contact area width (CW=2.4 mm) between the leaf spring member 16*c* 16*c* and the development roller 16*b*, the recording quality was evaluated as excellent. That is, even after running recording of 20,000 sheets of recording paper, a sufficient recording density OD of 1.4 was obtained. Even with all-black recording, the unevenness of density was a small 0.10 and, further, the fogging density was a small value not visually discernible (fogging density OD≦0.01: value obtained by subtracting optical reflection density OD of 0.1 of recording paper). In short, when the contact area width CW between the leaf spring member 16*c* and the development roller 16*b* is 2.4 mm, the flexible length FL of the leaf spring member 16*c* should be made within a range of 2.4 mm to about 4 mm.

Note that as is clear from the graph of FIG. 22, when the flexible length FL of the leaf spring member 16*c* is made within the range of 2.4 mm to 4 mm, the thickness of the toner layer is regulated to about 10 μm, it was learned. The thickness 10 μm substantially matches the average particle size of the toner particles. This means that the toner layer is regulated as a single layer of toner particles. In this case, it becomes possible to charge the individual toner particles by a sufficient charge by charge implantation, so the occurrence of fogging can be greatly suppressed.

Figure 24:
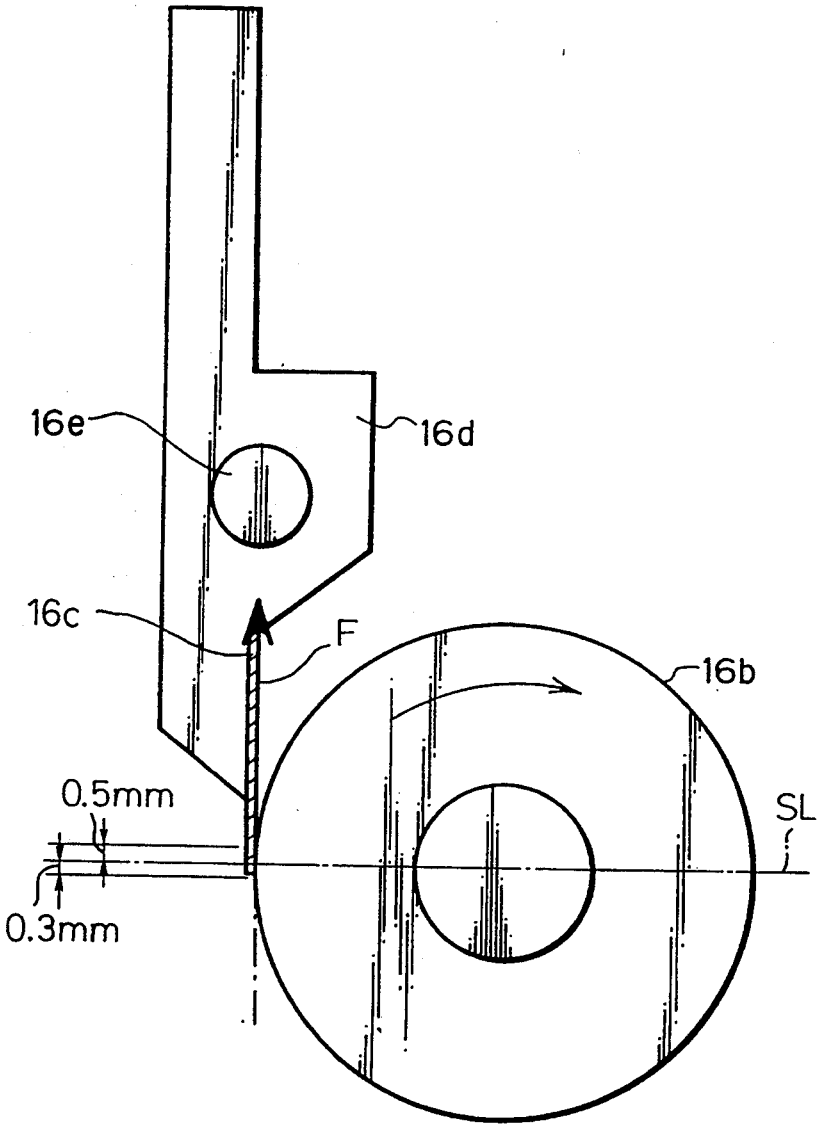
FIG. 24 is an enlarged view showing the development roller, leaf spring member, and rigid support member taken out of the developing apparatus shown in FIG. 1, which view explains other characteristics of the present invention.

Further, in the present invention, to suitably regulate the thickness of the toner layer, the rounded front edge of the protruding end of the leaf spring member 16*c* has to be positioned in a predetermined range based on the contact point between the leaf spring member 16*c* and the development roller 16*b*, it was confirmed by the following experiment. More accurately, as shown in FIG. 24, when the line perpendicular to the tangent between the leaf spring member 16*c* and the development roller 16*b* and passing through the contact point between the two is made the standard line SL, the rounded front edge of the protruding end of the leaf spring member 16*c* has to be positioned between a location 0.3 mm apart from the standard line SL at the upstream side of the moving surface of the development roller 16*b* passing through the standard line SL and a location 0.5 mm apart from the standard line at the downstream side of the moving surface.

Figure 25:
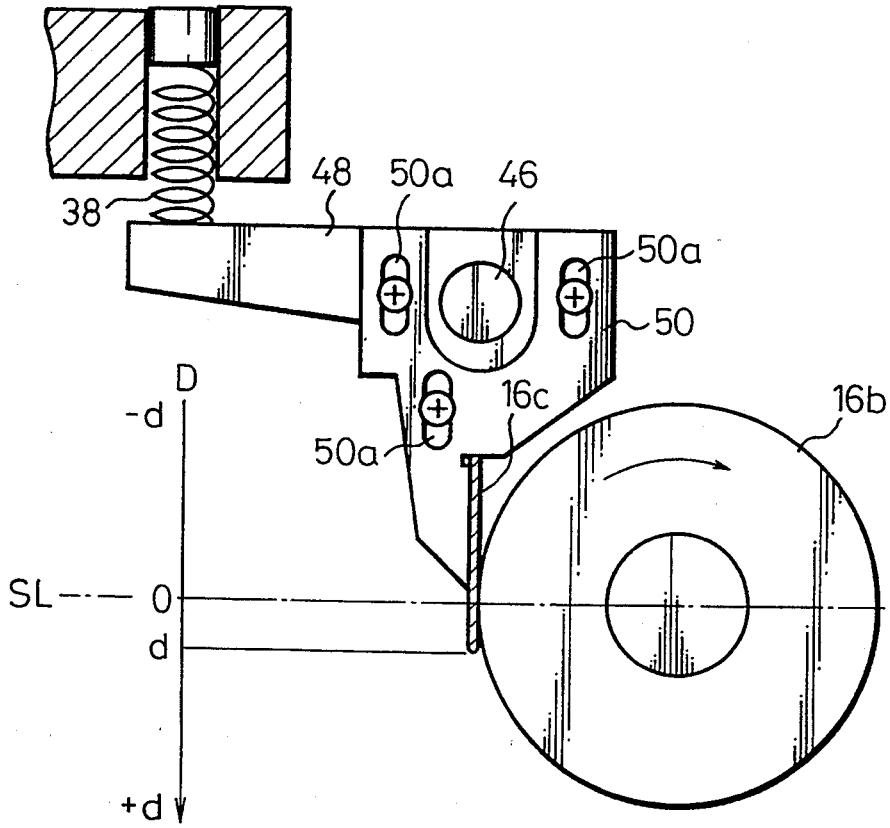
FIG. 25 is a schematic view showing a support apparatus constituted so as to enable adjustment of the position of the leaf spring member with respect to the development roller of the developing apparatus.

First, before the experiment, the support apparatus of the leaf spring member 16*c* shown in FIG. 25 was prepared. The support apparatus was provided with a fixed shaft 46 placed at a predetermined position and a rigid support member 48 attached detachably to the shaft 40. On this rigid support member 48 was displaceably attached a mounting member 50 affixing and holding the leaf spring member 16*c*. That is, the mounting member 50 is attached to the rigid support member 48 by passing stopscrews 50*b* through the elongated holes 50*a* formed there, whereby the mounting member 50 is made displaceable in the perpendicular direction with respect to the standard line SL and therefore adjustment of the position of the leaf spring member 16c with respect to the standard line SL becomes possible. The coil spring 38 is made to act on the rigid support member 48, whereby the leaf spring member 16c is elastically pressed against the development roller 16b and, further, the center of rotation of the shaft 46 of the rigid support member 48 is positioned on the tangent between the leaf spring member 16c and the development roller 16b. In short, except for the point that adjustment of the position of the leaf spring member 16c is possible, the support apparatus of FIG. 25 is equivalent to that shown in FIG. 1.

Note that in FIG. 25, reference symbol D shows the coordinate axis perpendicularly intersecting with the standard line SL. The point of intersection forms the origin of the coordinates. The position of the rounded front edge of the leaf spring member 16c with respect to the standard line SL is specified by the coordinate axis D as the amount of protrusion of the leaf spring member 16c from the standard line SL. That is, when the protruding end of the leaf spring member 16c actually protrudes from the standard line SL as shown in FIG. 25, the distance from the standard line SL to the rounded front edge is defined as a plus protrusion amount d, while when the protruding end of the leaf spring member 16c does not actually protrude from the standard line SL, the distance from the rounded front edge to the standard line SL is defined as a minus protrusion amount d. Of course, when the rounded front edge of the protruding end of the leaf spring member 16c is positioned on the standard line SL, the amount of protrusion is defined as zero.

Figure 26:
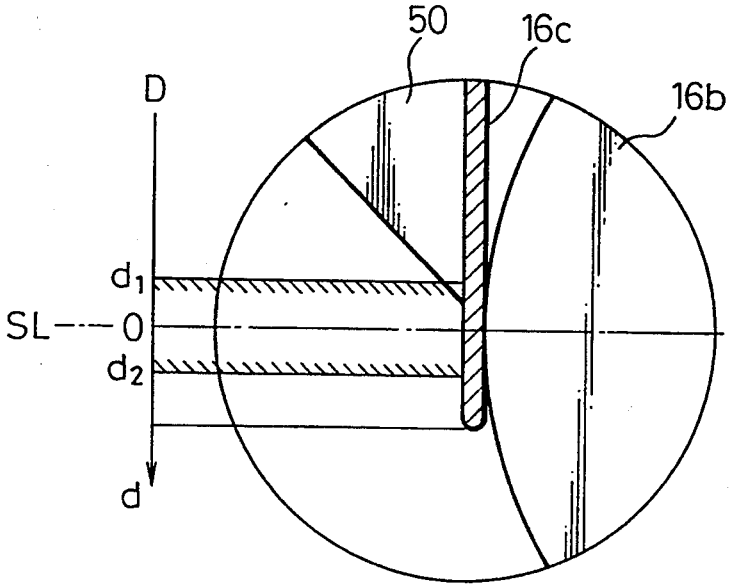
FIG. 26 is a partial enlarged view showing an enlargement of the contact portion of the development roller and the leaf spring member shown in FIG. 25, which view shows the relationship of arrangement of the development roller and leaf spring member of the developing apparatus.
Figure 27:
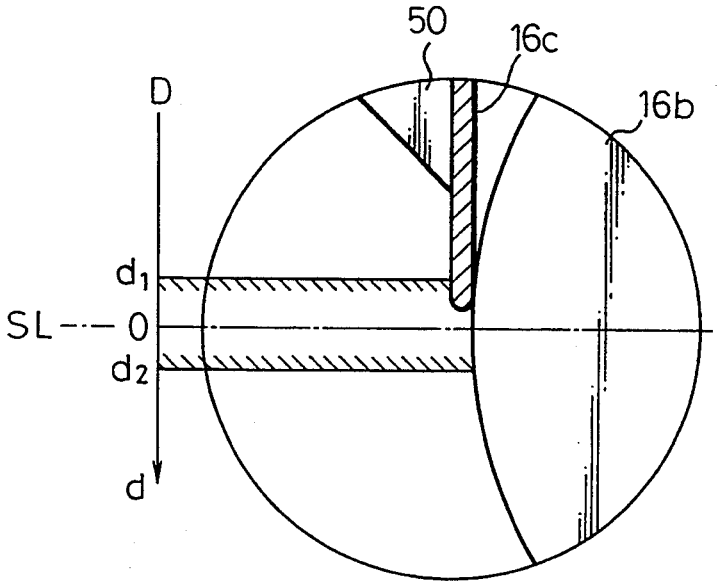
FIG. 27 is a partial enlarged view the same as FIG. 26, which view shows another relationship of arrangement of the development roller and leaf spring member of the developing apparatus.
Figure 28:
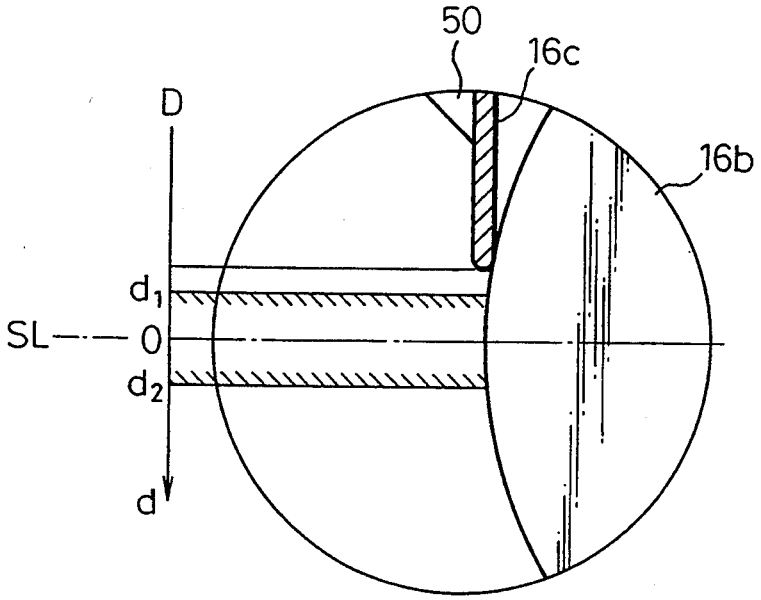
FIG. 28 is a partial enlarged view the same as FIG. 26, which view shows still another relationship of arrangement of the development roller and leaf spring member of the developing apparatus.

FIG. 26 to FIG. 28 each show an enlargement of the rounded front edge of the protruding end of the leaf spring member 16c of FIG. 3. In FIG. 26, the protrusion amount d is a plus amount, while in FIG. 27 and FIG. 28, the protrusion amounts d are minus amounts. The protrusion amounts $d_1$ and $d_2$ are equal to −0.5 mm and 0.3 mm, respectively. The range is the same as that shown in FIG. 24.

Figure 29:
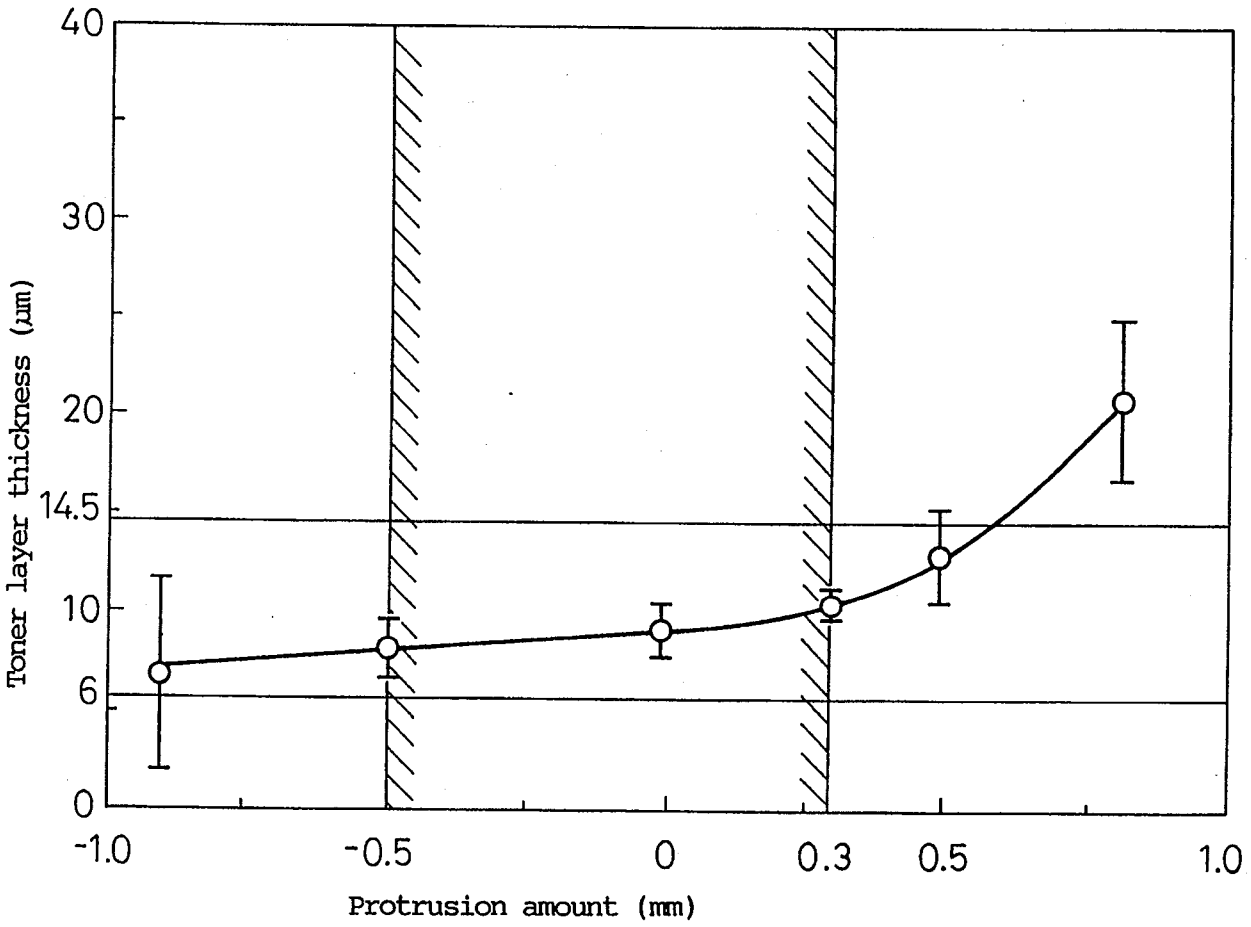
FIG. 29 is a graph showing the results of measurement when measuring the thickness of the toner layer on the development roller according to the measurement method of FIG. 5 for each of the arrangement positions of the various types of leaf spring members illustrated in FIG. 26 to FIG. 28.

In the experiment, the protruding end of the leaf spring member 16c was made to protrude by six amounts, that is, −0.85 mm, −0.50 mm, 0 mm, 0.31 mm, 0.50 mm, and 0.80 mm. The thickness of the toner layer was regulated by these protrusion amounts, then the thickness of the toner layer was measured by the laser scan micromeasurement apparatus 34 of FIG. 5. Note that the measurement of the thickness of the toner layer was repeated five times for each of the protrusion amounts. The results of the measurement are shown in the graph of FIG. 29. Further, the fogging at the photosensitive drum 10 was measured in parallel with the measurement of the thickness of the toner layer. The fogging was measured by sticking scotch mending tape on the surface of the photosensitive layer of the photosensitive drum 10, then peeling the tape from it and measuring the sticking side of the tape by an optical reflection densitometer. The results are shown by the graph of FIG. 30.

As shown in the graph of FIG. 29, when the protrusion amount d becomes over 0.8 mm (for example, FIG. 26), it is learned that not only the average thickness of the toner layer, but also the variation fall out of the suitable range of 6 to 14.5 μm where an excellent recording quality is obtained. On the other hand, as is clear from the graph of FIG. 30, when $d \leqq 0.3$ mm, the fogging density (OD) rapidly rises. In short, when the protrusion amount d of the leaf spring member 16c becomes over $d \geqq 0.3$ mm, the scraping off effect of the toner layer by the rounded front edge falls and therefore the amount of the toner which passes through the leaf spring member 16c 16c increases. If the thickness of the toner layer is increased, the average charge of the toner particles falls and this becomes a cause of fogging.

Figure 30:
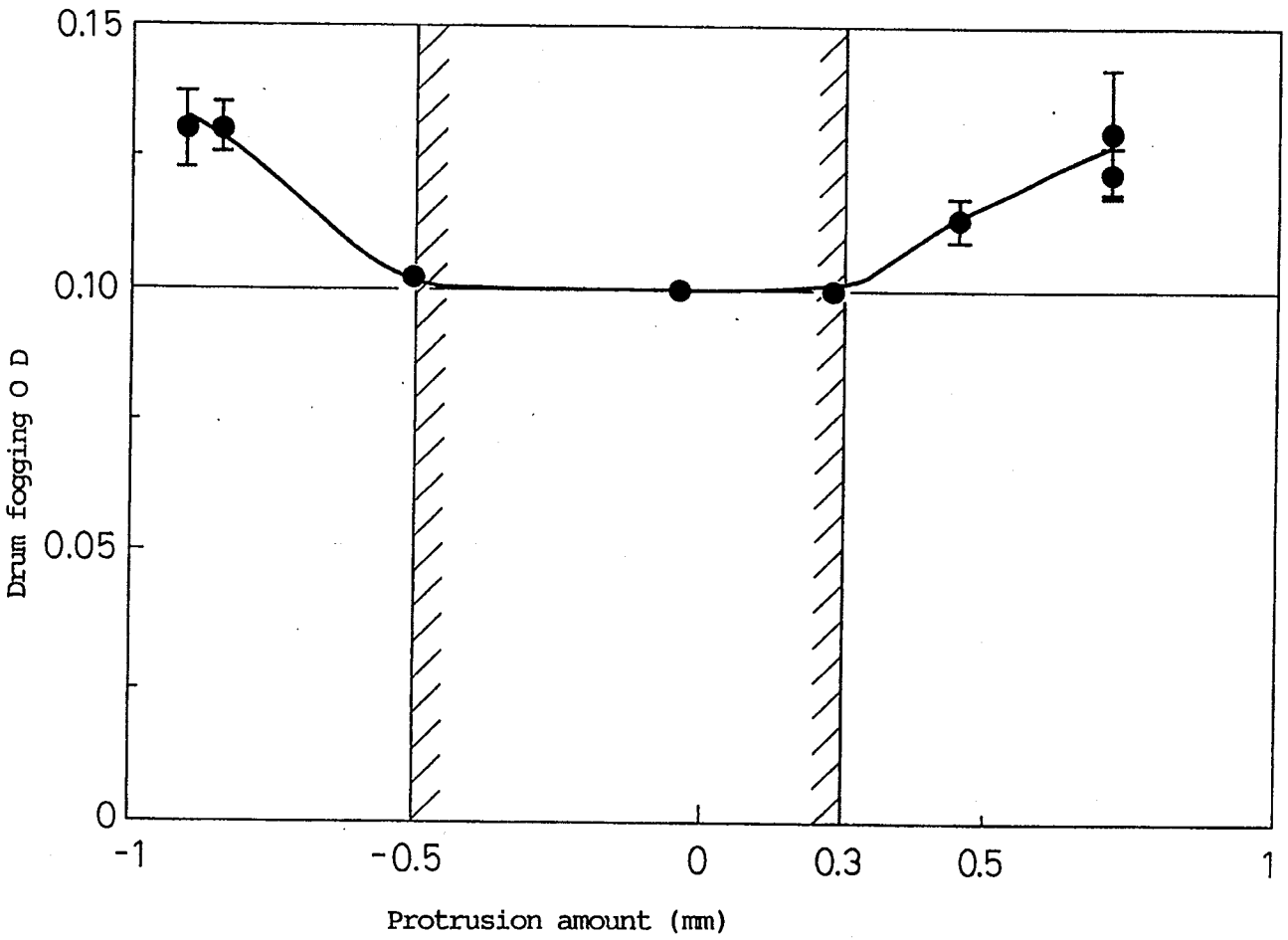
FIG. 30 is a graph showing the results of measurement when measuring the fogging on the photosensitive drum when measuring the thickness on the toner layer on the development roller according to the measurement method of FIG. 5 for each of the arrangement positions of the various types of leaf spring members illustrated in FIG. 26 to FIG. 28.

Further, as shown by the graph of FIG. 30, even when $d \leqq -0.50$ mm, the fogging density rapidly rises. When the amount of protrusion of the leaf spring member 16c is less than −0.50 mm, as shown by the graph of FIG. 29, the thickness of the toner layer is relatively small. This is an effect contradictory to the above explanation. The reason is believed to be that when $d \leqq -0.50$ mm, the rounded front edge of the leaf spring member 16c bites into the development roller 16b as shown in FIG. 28, so the leaf spring member 16c violently vibrates and there is a great fluctuation in the thickness of the toner layer.

From the above results, the protrusion amount d of the leaf spring member 16c should be set within the predetermined range mentioned above, that is, the following range:

$0.50 \text{ mm } (d_1) \leqq d \leqq 0.3 \text{ mm } (d_2)$

Note that this range can change somewhat around the standard line SL, that is, at the contact point with the development roller 16b, due to differences in the diameter of the development roller 16b, but if the rounded front edge of the leaf spring member 16c is positioned near the contact point, that position will be included in the desired range, so there is no need to find the desired range of the protrusion of the leaf spring member for each individual development roller with a different diameter.

Figure 31A:
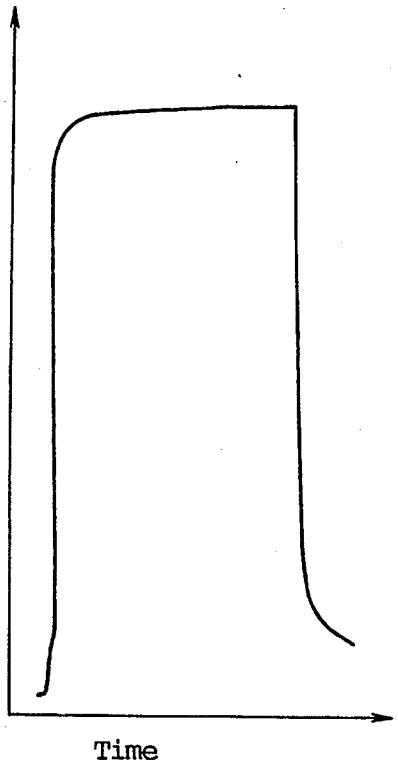
FIG. 31(*a*) and FIG. 31(*b*) are graphs showing the results of measurement when measuring the surface potential of the development roller for each of the arrangement positions of the various types of leaf spring members illustrated in FIG. 27 and FIG. 28.
Figure 31B:
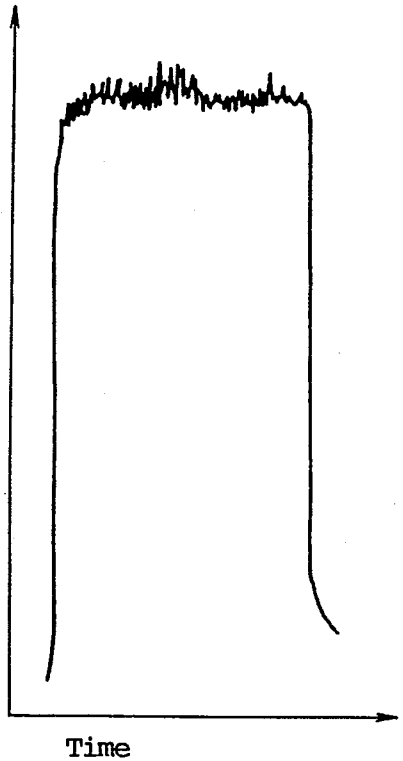

Next, the state of occurrence of the vibration of the leaf spring member 16c when the protrusion amount d of the leaf spring member 16c is less than −0.50 mm was examined by the method shown in FIG. 7. The results of measurement of the surface potential of the development roller 16b in the case where $0 \leqq d \leqq 0.3$ mm and where $d \leqq -0.50$ mm are shown in FIG. 31. As clear from the graph of FIG. 31(*a*), when $0 \leqq d \leqq 0.3$ mm, . the surface potential of the development roller 16b stabilizes at the peak region. This shows that no vibration occurs at the leaf spring member 16c. As opposed to this, when $d \leqq -0.50$ mm, the surface potential of the development roller 16b is unstable at the peak region. This shows that vibration occurs at the leaf spring member 16c.

Further, the recording quality was evaluated by performing running recording of 20,000 sheets of recording paper (A4 size) at each of the above protrusion amounts. At this time, all-black recording (exposure of the entire surface of the photosensitive drum 10), all-white recording (no exposure of the photosensitive drum 10), and parallel hatching line pattern recording comprised of a large number of one-dot hatching lines at an angle of 45° (pitch between hatching lines in horizontal direction: 8 dots) were performed on the recording sheets. For the evaluation, the recording of the first recording sheet and the recording of the 20,000 th recording sheet were selected. As a result, black streaks and white streaks appeared in the all-black recording and parallel hatching line pattern recording only when $d = 0.80$ mm. In the case of the parallel hatching line pattern recording, the difference between the maximum value (black streak) and minimum value (white streak)

of the average optical reflectance density OD* for a 4 mm diameter region was evaluated, whereupon an average recording density difference 0.10 appeared in the parallel hatching line pattern recording after the running recording of 20,000 sheets of recording paper. This was far higher than the visually discernible density difference of 0.03. Therefore, the developing apparatus was disassembled and the cause was investigated, whereupon it was found that the toner particles deposited at the thickness-regulating surface of the leaf spring member 16*c* and the locations of deposition of the toner particles matched the location of the front end of the mounting member 50 positioned at the back side of the thickness-regulating surface. The reason for this is believed that since the protrusion amount d (0.80 mm) of the leaf spring member 16*c* is large, the contact point between the leaf spring member 16*c* and the development roller 16*b* overly approaches the location of the front end of the mounting member 50 and the flexibility of the leaf spring member 16*c* is lost, so during running recording of 20,000 sheets of paper, the lower portion of the leaf spring member 16*c* bends to become somewhat away from the development roller 16*b* at the front end location of the mounting member 50 and the toner particles are crammed in between. That is, these crammed in toner particles are believed to be crushed against the thickness-regulating surface of the leaf spring member 16*c* and deposited there. On the other hand, with a protrusion amount of $-0.50$ mm $\leqq d \leqq 0.3$ mm, the recording quality was evaluated as excellent. That is, even after running recording of 20,000 sheets, a sufficient recording density OD of 1.4 was obtained. Further, the unevenness of density was a small 0.10 even with all-black recording. Further, the fogging density was a small value unable to be visually discerned (fogging density OD $\leqq 0.01$; value obtained by subtracting optical reflection density OD 0.1 of recording paper).

We claim:

1. A developing apparatus for developing an electrostatic latent image held on an image carrier by a mono-component developer, said apparatus comprising:

a developer holding container for holding the mono-component developer;

an electroconductive elastic development roller rotatably provided inside said container so that a portion of said development roller is exposed from said container and contacts the image carrier, the developer being made to deposit on a surface of said development roller and form a mono-component developer layer during rotation of said development roller, the developer layer being transported to the image carrier for development of the latent image formed thereon; and regulation means for regulating a thickness of the developer layer formed on said development roller, said regulation means including an electroconductive leaf spring member, and a rigid support member for securely supporting one end of said leaf spring member, said rigid support member being rotatable such that another end of said leaf spring member is elastically pressed against said development roller for the regulation of the thickness of the developer layer, a center of rotation of said rigid support member being substantially positioned on a tangent of said leaf spring member and said development roller, and a front edge of said other end of said leaf spring member being chamfered to give the front edge roundness, a radius of the rounded front edge being made to be from about 0.03 mm to about 0.07 mm.

2. A developing apparatus as set forth in claim 1, wherein the center of rotation of said rigid support member is made to match the tangent of said leaf spring member and said development roller upon releasing an elastic pressure exerted on said leaf spring member by said rigid support member for elastically pressing said leaf spring member against said development roller.

3. A developing apparatus as set forth in claim 1, wherein said leaf spring member is formed from a metal material, and is connected to an electrical energy source to inject an electrical charge, having a predetermined polarity, into the developer layer during the regulation of the thickness thereof.

4. A developing apparatus as set forth in claim 1, wherein said development roller is formed from an electroconductive porous rubber material.

5. A developing apparatus for developing an electrostatic latent image held on an image carrier by a mono-component developer, said apparatus comprising:

a developer holding container for holding the mono-component developer;

an electroconductive elastic development roller rotatably provided inside said container so that a portion of said development roller is exposed from said container and contacts the image carrier, the developer being made to deposit on a surface of said development roller and form a mono-component developer layer during rotation of said development roller, the developer layer being transported to the image carrier for development of the latent image formed thereon; and regulation means for regulating a thickness of the developer layer formed on said development roller, said regulation means including an electroconductive leaf spring member, and a rigid support member for securely supporting one end of said leaf spring member, said rigid support member being elastically rotatable such that another end of said leaf spring member is elastically pressed against said development roller for the regulation of the thickness of the developer layer, a center of rotation of said rigid support member being substantially positioned on a tangent of said leaf spring member and said development roller, and said leaf spring member being supported by said rigid support member to give a flexible length of less than about 4 mm to said other end of said leaf spring member so as to stably regulate the thickness of the developer layer to a predetermined thickness.

6. A developing apparatus as set forth in claim 5, wherein the flexible length is made to be more than a contact width between said leaf spring member and said development roller.

7. A developing apparatus as set forth in claim 5, wherein the center of rotation of said rigid support member is made to match the tangent of said leaf spring member and said development roller upon releasing an elastic pressure exerted on said leaf spring member by said rigid support member for elastically pressing said leaf spring member against said development roller.

8. A developing apparatus as set forth in claim 5, wherein said leaf spring member is formed from a metal material, and is connected to an electrical energy source to inject an electrical charge, having a predetermined polarity, into the developer layer during the regulation of the thickness thereof.

9. A developing apparatus as set forth in claim 5, wherein said development roller is formed from an electroconductive porous rubber material.

10. A developing apparatus as set forth in claim 5, wherein a front edge of said other end of said leaf spring member is chamfered to give the front edge roundness.

11. A developing apparatus as set forth in claim 10, wherein a radius of the rounded front edge is made to be from about 0.03 mm to about 0.07 mm.

12. A developing apparatus for developing an electrostatic latent image held on an image carrier by a mono-component developer, said apparatus comprising:

a developer holding container for holding the mono-component developer;

an electroconductive elastic development roller rotatably provided inside said container so that a portion of said development roller is exposed from said container and contacts the image carrier, the developer being made to deposit on a surface of said development roller and form a mono-component developer layer during rotation of said development roller, the developer layer being transported to the image carrier for development of the latent image formed thereon; and regulation means for regulating a thickness of the developer layer formed on said development roller, said regulation means including an electroconductive leaf spring member, and a rigid support member for securely supporting one end of said leaf spring member, said rigid support member being rotatable such that another end of said leaf spring member is elastically pressed against said development roller for the regulation of the thickness of the developer layer, a center of the rotation of said rigid support member being substantially positioned on a tangent of said leaf spring member and said development roller, and a front edge of said other end of said leaf spring member being positioned at a contact point between said leaf spring member and said development roller for stably regulating the thickness of the developer layer to a predetermined thickness.

13. A developing apparatus as set forth in claim 12, wherein the center of rotation of said rigid support member is made to match the tangent of said leaf spring member and said development roller upon releasing an elastic pressure exerted on said leaf spring member by said rigid support member for elastically pressing said leaf spring member against said development roller.

14. A developing apparatus as set forth in claim 12, wherein said leaf spring member is formed from a metal material, and is connected to an electrical energy source to inject an electrical charge, having a predetermined polarity, into the developer layer during the regulation of the thickness thereof.

15. A developing apparatus as set forth in claim 12, wherein said development roller is formed from an electroconductive porous rubber material.

16. A developing apparatus as set forth in claim 12, wherein a front edge of said other end of said leaf spring member is chamfered to give the front edge roundness.

17. A developing apparatus for developing an electrostatic latent image held on an image carrier by a mono-component developer, said apparatus comprising:

a developer holding container for holding the mono-component developer;

an electroconductive elastic development roller rotatably provided inside said container so that a portion of said development roller is exposed from said container and contacts the image carrier, the developer being made to deposit on a surface of said development roller and form a mono-component developer layer during rotation of said development roller, the developer layer being transported to the image carrier for development of the latent image formed thereon;

regulation means for regulating a thickness of the developer layer formed on said development roller, said regulation means including an electroconductive leaf spring member, and a rigid support member for securely supporting one end of said leaf spring member, said rigid support member being rotatable such that another end of said leaf spring member is elastically pressed against said development roller for the regulation of the thickness of the developer layer; and a center of the rotation of said rigid support member being substantially positioned on a tangent of said leaf spring member and said development roller, and a front edge of said other end of said leaf spring member being substantially positioned at a contact point between said leaf spring member and said development roller for stably regulating the thickness of the developer layer to a predetermined thickness, the front edge of said other end of said leaf spring member being chamfered to give the front edge roundness and a radius of the rounded front edge being made to be from about 0.03 mm to about 0.07 mm.

18. A developing apparatus for developing an electrostatic latent image held on an image carrier by a mono-component developer, said apparatus comprising:

a developer holding container for holding the mono-component developer;

an electroconductive elastic development roller rotatably provided inside said container so that a portion of said development roller is exposed from said container and contacts the image carrier, the developer being made to deposit on a surface of said development roller and form a mono-component developer layer during rotation of said development roller, the developer layer being transported to the image carrier for development of the latent image formed thereon; and regulation means for regulating a thickness of the developer layer formed on said development roller, said regulation means including an electroconductive leaf spring member, and a rigid support member for securely supporting one end of said leaf spring member, said rigid support member being rotatable such that another end of said leaf spring member is elastically pressed against said development roller for the regulation of the thickness of the developer layer; and a center of the rotation of said rigid support member being substantially positioned-on a tangent of said leaf spring member and said development roller, and a front edge of said other end of said leaf spring member being substantially positioned at a contact point between said leaf spring member and said development roller for stably regulating the thickness of the developer layer to a predetermined thickness, said leaf spring member being supported by said rigid support member so as to give a flexible length of less than about 4 mm to said other end of said leaf spring member.

19. A developing apparatus as set forth in claim 18, wherein a front edge of said other end of said leaf spring member is chamfered to give the front edge roundness.

20. A developing apparatus as set forth in claim 19, wherein a radius of the rounded front edge is made to be from about 0.03 mm to about 0.07 mm.

21. A developing apparatus for developing an electrostatic latent image held on an image carrier by a mono-component developer, said apparatus comprising:

a developer holding container for holding the mono-component developer;

an electroconductive elastic development roller rotatably provided inside said container so that a portion of said development roller is exposed from said container and contacts the image carrier, the developer being made to deposit on a surface of said development roller and form a mono-component developer layer during rotation of said development roller, the developer layer being transported to the image carrier for development of the latent image formed thereon; and regulation means for regulating a thickness of the developer layer formed on said development roller, said regulation means including an electroconductive leaf spring member, and a rigid support member for securely supporting one end of said leaf spring member, said rigid support member being rotatable such that another end of said leaf spring member is elastically pressed against said development roller for the regulation of the thickness of the developer layer, a center of rotation of said rigid support member being substantially positioned on a tangent of said leaf spring member and said development roller, and a front edge of said other end of said leaf spring member being substantially positioned at a contact point between said leaf spring member and said development roller for stably regulating the thickness of the developer layer to a predetermined thickness, the substantial positioning of the front edge of said leaf spring member being performed with respect to a rotating moving surface of said development roller at the contact point in a range between a location from the contact point to about 0.3 mm toward an upstream side thereof and a location from the contact point to about 0.5 mm toward a downstream side thereof.

22. A developing apparatus as set forth in claim 21, wherein the center of rotation of said rigid support member is made to match the tangent of said leaf spring member and said development roller upon releasing an elastic pressure exerted on said leaf spring member by said rigid support member for elastically pressing said leaf spring member against said development roller.

23. A developing apparatus as set forth in claim 21, wherein said leaf spring member is formed from a metal material, and is connected to an electrical energy source to inject an electrical charge, having a predetermined polarity, into the developer layer during the regulation of the thickness thereof.

24. A developing apparatus as set forth in claim 21, wherein said development roller is formed from an electroconductive porous rubber material.

25. A developing apparatus as set forth in claim 21, wherein a front edge of said other end of said leaf spring member is chamfered to give the front edge roundness.

26. A developing apparatus as set forth in claim 25, wherein a radius of the rounded front edge is made to be from about 0.03 mm to about 0.07 mm.

27. A developing apparatus as set forth in claim 21, wherein said leaf spring member is supported by said rigid support member to give a flexible length of less than about 4 mm to said other end of said leaf spring member.

28. A developing apparatus as set forth in claim 27, wherein a front edge of said other end of said leaf spring member is chamfered to give the front edge roundness.

29. A developing apparatus as set forth in claim 28, wherein a radius of the rounded front edge is made to be from about 0.03 mm to about 0.07 mm.

30. A developing apparatus for developing an electrostatic latent image held on an image carrier by a mono-component developer, the apparatus comprising:

a developer holding container for holding the mono-component developer;

an electroconductive elastic development roller rotatably provided inside said container so that a portion of said development roller is exposed from said container and contacts the image carrier, the developer being made to deposit on a surface of said development roller and form a mono-component developer layer during rotation of said development roller, the developer layer being transported to the image carrier for development of the latent image formed thereon; and regulation means for regulating a thickness of the developer layer formed on said development roller, said regulation means including an electroconductive leaf spring member, and a rigid support member for securely supporting one end of said leaf spring member, said rigid support member being rotatable such that another end of said leaf spring member is elastically pressed against said development roller for the regulation of the thickness of the developer layer, a center of rotation of said rigid support member being substantially positioned on a tangent of said leaf spring member and said development roller, and a front edge of said other end of said leaf spring member being chamfered to give the front edge roundness, and the front edge being positioned at a contact point between said leaf spring member and said development roller for stably regulating the thickness of the developer layer to a predetermined thickness.

31. A developing apparatus for developing an electrostatic latent image held on an image carrier by a mono-component developer, said apparatus comprising:

a developer holding container for holding the mono-component developer;

an electroconductive elastic development roller rotatably provided inside said container so that a portion of said development roller is exposed from said container and contacts the image carrier, the developer being made to deposit on a surface of said development roller and form a mono-component developer layer during rotation of said development roller, the developer layer being transported to the image carrier for development of the latent image formed thereon; and regulation means for regulating a thickness of the developer layer formed on said development roller, said regulation means including an electroconductive leaf spring member, and a rigid support member for securely supporting one end of said leaf spring member, said rigid support member being rotatable such that another end of said leaf spring member is elastically pressed against said development roller for the regulation of the thickness of the developer layer, a center of rotation of said rigid support member being substantially positioned on a tangent of said leaf spring member and said development roller, and a front edge of said other end of said leaf spring member being chamfered to give the front edge roundness, a radius of the rounded front edge being made to be from about 0.03 mm to about 0.07 mm, the front edge of said other end of said leaf spring member being substantially positioned at a contact point between said leaf spring member and said development roller for stably regulating the thickness of the developer layer to a predetermined thickness.

* * * * *

UNITED STATES PATENT AND TRADEMARK OFFICE

CERTIFICATE OF CORRECTION

PATENT NO. : 5,412,458

DATED : May 2, 1995

INVENTOR(S) : KAMAJI et al.

It is certified that error appears in the above-indentified patent and that said Letters Patent is hereby corrected as shown below:

Col. 8, line 23, change "10" to --$10^4$--.

Col. 21, line 45, change "0.31" to --0.30--;
line 68, change "$d \leq 0.3$ mm" to --$d \geq 0.3$ mm--.

Signed and Sealed this

Twenty-first Day of November, 199

*Attest:*

*Attesting Officer*

BRUCE LEHMAN

*Commissioner of Patents and Trademarks*